US005911091A

United States Patent [19]

Matsumoto et al.

[11] Patent Number: 5,911,091

[45] Date of Patent: Jun. 8, 1999

[54] METHOD AND APPARATUS FOR PROCESSING PHOTOSENSITIVE MATERIALS

[75] Inventors: Nobuo Matsumoto; Tadashi Tanaka, both of Kanagawa, Japan

[73] Assignee: Fuji Photo Film Co., Ltd., Kanagawa, Japan

[21] Appl. No.: 08/557,567

[22] Filed: Nov. 14, 1995

[30] Foreign Application Priority Data

Nov. 15, 1994 [JP] Japan ..... 6-280703
Feb. 6, 1995 [JP] Japan ..... 7-018136

[51] Int. Cl.[6] ..... G03D 3/08

[52] U.S. Cl. ..... 396/615

[58] Field of Search ..... 354/298, 319–322, 354/339, 333, 334; 226/196, 199; 396/612, 615, 622

[56] References Cited

U.S. PATENT DOCUMENTS

| | | | |
|---|---|---|---|
| 4,666,279 | 5/1987 | Fujita | 354/320 |
| 4,903,064 | 2/1990 | Kogane et al. | 354/321 |
| 5,227,827 | 7/1993 | Murakami | 354/333 |
| 5,452,040 | 9/1995 | Nishida et al. | 354/298 |
| 5,475,465 | 12/1995 | Narukami et al. | 354/339 |

FOREIGN PATENT DOCUMENTS 1-205166 8/1989 Japan ..... G03D 3/13

*Primary Examiner*—D. Rutledge
*Attorney, Agent, or Firm*—Sughrue, Mion, Zinn, Macpeak & Seas, PLLC

[57] ABSTRACT

A method for processing photosensitive materials in which photosensitive materials are conveyed along a serial conveyance passage while guiding the photosensitive materials on both sides thereof by using pairs of guide members to successively perform development processing steps comprises the steps of dividing the conveyance passage into a plurality of blocks, a spacing distance between the pair of guide members on the conveyance passage being changeable in each of the divided blocks, and changing the spacing distance between the pair of guide members in each of the blocks, when a photosensitive material having a different widthwise dimension is introduced into the conveyance passage, in accordance with the widthwise dimension of the photosensitive material before introducing a forward end of the photosensitive material having the different widthwise dimension into each of the blocks. Therefore, when photosensitive materials having different widthwise dimensions are alternately processed, it is possible to start processing for a following photosensitive material during a period in which a preceding photosensitive material is processed on the conveyance passage.

33 Claims, 18 Drawing Sheets

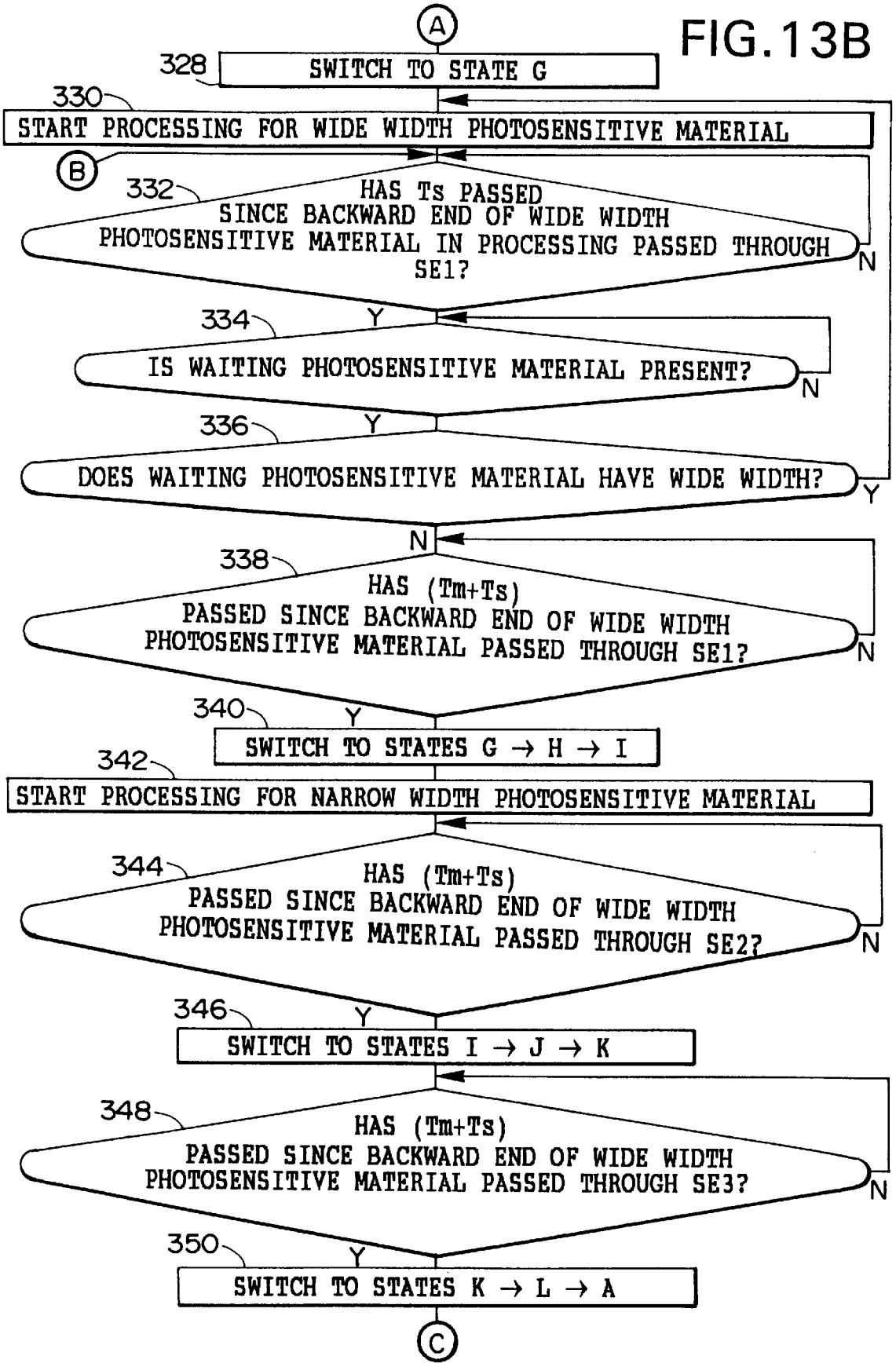
FIG. 13B
A
328
SWITCH TO STATE G
330
START PROCESSING FOR WIDE WIDTH PHOTOSENSITIVE MATERIAL
B
332
HAS Ts PASSED SINCE BACKWARD END OF WIDE WIDTH PHOTOSENSITIVE MATERIAL IN PROCESSING PASSED THROUGH SE1?
N
Y
334
IS WAITING PHOTOSENSITIVE MATERIAL PRESENT?
N
Y
336
DOES WAITING PHOTOSENSITIVE MATERIAL HAVE WIDE WIDTH?
Y
N
338
HAS (Tm+Ts) PASSED SINCE BACKWARD END OF WIDE WIDTH PHOTOSENSITIVE MATERIAL PASSED THROUGH SE1?
N
Y
340
SWITCH TO STATES G → H → I
342
START PROCESSING FOR NARROW WIDTH PHOTOSENSITIVE MATERIAL
344
HAS (Tm+Ts) PASSED SINCE BACKWARD END OF WIDE WIDTH PHOTOSENSITIVE MATERIAL PASSED THROUGH SE2?
N
Y
346
SWITCH TO STATES I → J → K
348
HAS (Tm+Ts) PASSED SINCE BACKWARD END OF WIDE WIDTH PHOTOSENSITIVE MATERIAL PASSED THROUGH SE3?
N
Y
350
SWITCH TO STATES K → L → A
C

METHOD AND APPARATUS FOR PROCESSING PHOTOSENSITIVE MATERIALS

BACKGROUND OF THE INVENTION

1. Field of the Invention

The present invention relates to a method and an apparatus for processing photosensitive materials. In particular, the present invention relates to a method for processing photosensitive materials for successively and automatically performing a series of development processing steps for photosensitive materials having different widthwise dimensions, and an apparatus for processing photosensitive materials to which the method for processing photosensitive materials is applicable.

2. Description of the Related Art

An apparatus for processing photosensitive materials for performing a series of processing steps such as development is used for photosensitive materials such as films and photographic paper, in which a lengthy photosensitive material is successively immersed in solutions for development, bleaching, fixation, washing, and stabilization in each of processing tanks by conveying it on a serial conveyance passage by roller conveyance or the like, and it is dried by conveyance through a drying section. Thus a series of processing steps is automatically performed. Such an apparatus for processing photosensitive materials is provided with guide racks for introducing the lengthy photosensitive material into each of the processing tanks.

In the conventional art, a guide rack as described above is known, as disclosed in Japanese Patent Laid-open No. 1-205166 shown in FIG. 18.

This guide rack comprises a pair of side plates 12 provided with fastening portions 10 for fastening to both edges of a processing tank upon attachment of the rack to the processing tank, guide rollers 14, 16 rotatably spanned between the side plates 12 and provided at upper and lower positions respectively for guiding a lengthy photosensitive material 11 into the processing tank through a U-shaped conveyance passage, a pair of edge guides 18 for guiding both side edges of the lengthy photosensitive material 11 between the guide rollers 14, 16, and a guide width changing means 20 for changing a spacing distance between the edge guides 18 (guide width) in accordance with a widthwise dimension of the photosensitive material 11.

The guide width changing means 20 includes an edge guide width changing dial 22 provided on an upper end of the side plate 12, a scale unit 24 for indicating an edge guide width, a rotatable shaft 26 coupled to the dial 22, movement screw rods 32 rotatably spanned between the side plates 12 and coupled to the rotatable shaft 26 through bevel gears 28, 30, and female screw portions 36 provided in the edge guides 18 for engaging with male screw portions 34 of the movement screw rods 32. As for the male screw portion 34 of the movement screw rods 32 described above, those for the first side plate 12 have threads in a direction opposite to those for the second side plate 12. Therefore, when the dial 22 is rotated, and the movement screw rods 32 are rotated in one direction, the pair of edge guides 18 are separated from one another through the female screw portions 36. When they are rotated in the other direction, the pair of edge guides 18 approach one another. Thus this system makes it possible to set the spacing distance between the edge guides 18 or the guide width to be a desired value corresponding to the widthwise dimension of the photosensitive material 11.

When a lengthy photosensitive material 11 having a different widthwise dimension is subjected to development processing in a processing apparatus having the guide racks as described above, adjustment is performed after all of the photosensitive material 11 in processing in the processing apparatus are discharged from the conveyance passage of the processing apparatus. This adjustment is primarily performed so that the spacing distance between the edge guides 18 of all of the guide racks for regulating and guiding the widthwise direction of the photosensitive material 11 on the conveyance passage is reset to be a spacing distance corresponding to the widthwise dimension of the photosensitive material 11 to be processed thereafter. The processing for the photosensitive material 11 having the different widthwise dimension is started after completion of the adjustment.

However, such a conventional processing apparatus has a complicated structure of the guide width changing means provided for each of the guide racks. Thus the apparatus is expensive. In addition, it is impossible to alter the spacing distance between the edge guides during processing for the photosensitive material in the processing apparatus. Therefore, the widthwise dimension of the edge guides should be changed, and a photosensitive material having a different widthwise dimension should be set to the processing apparatus to start processing, after completion of processing for a photosensitive material having a predetermined widthwise dimension in the processing apparatus, and after discharge of the entire photosensitive material from the conveyance passage of the processing apparatus.

The processing for the photosensitive material is interrupted every time the spacing distance between the edge guides is changed as described above. Thus a problem arises in that the processing ability (the number of photosensitive materials processed per unit time) of the processing apparatus is deteriorated. Especially, when a plurality of photosensitive materials having different widthwise dimensions are alternately processed, the apparatus repeats steps of processing a photosensitive material, and then changing the spacing distance between the edge guides in accordance with a widthwise dimension of a photosensitive material to be subsequently processed. Thus the processing ability of the processing apparatus is greatly deteriorated.

SUMMARY OF THE INVENTION

The present invention has been made taking the aforementioned facts into consideration, an object of which is to obtain a method for processing photosensitive materials in which efficiency of the processing is maintained even when photosensitive materials having different widthwise dimensions are alternately processed.

Another object of the present invention is to obtain an apparatus for processing photosensitive materials having a simple structure and enabling inexpensive production in which efficiency of the processing is maintained even when photosensitive materials having different widthwise dimensions are alternately processed.

In order to achieve the objects described above, the first aspect of the present invention lies in a method for processing photosensitive materials in which photosensitive materials are conveyed on a serial conveyance passage while guiding them on both sides by using pairs of guide members to successively perform development processing steps, comprising dividing the conveyance passage into a plurality of blocks, a spacing distance between the pair of guide members on the conveyance passage being changeable in each of the divided blocks, and enlarging or reducing the spacing distance between the pair of guide members in each of the blocks, when a photosensitive material having a different widthwise dimension is introduced into the conveyance passage, in accordance with the widthwise dimension of the photosensitive material before introducing a forward end of the photosensitive material having the different widthwise dimension into each of the blocks.

The second aspect lies in the method according to the first aspect described above, wherein the enlargement or reduction of the spacing distance between the guide members in each of the blocks is successively performed by using an identical driving source from upstream to downstream blocks in accordance with movement of the photosensitive materials.

The third aspect lies in an apparatus for processing photosensitive materials, comprising a large number of pairs of guide members with changeable spacing distances between each of them for successively guiding photosensitive materials on both sides conveyed from upstream to downstream sides on a serial conveyance passage for performing development processing steps on the photosensitive materials, the large number of the pairs of guide members being divided into groups from upstream to downstream sides so that they are included in each of a plurality of blocks, and a spacing distance changing means for changing the spacing distances between the guide members of each of the pairs with provision of phase differences from upstream to downstream blocks.

The fourth aspect lies in the apparatus according to the third aspect described above, wherein the spacing distance changing means includes a plurality of cams provided to correspond to each of the pairs of guide members respectively for changing the spacing distances between the guide members of each of the pairs, the cams have different phases for each of the guide members in each of the blocks, and being driven by an identical driving source.

The fifth aspect lies in the apparatus according to the third or fourth aspect described above, further comprising a conveyance control means for comparing a widthwise dimension of a preceding photosensitive material precedently introduced into the conveyance passage and processed with a widthwise dimension of a following photosensitive material subsequently introduced into the conveyance passage and processed, and changing a minimum interval between a backward end of the preceding photosensitive material and a forward end of the following photosensitive material conveyed on the conveyance passage in accordance with a result of the comparison.

The sixth aspect lies in the apparatus according to any one of the aspects 3–5 described above, further comprising a plurality of setting units capable of setting photosensitive materials to be introduced into the conveyance passage and processed respectively, and a designating means for designating a setting unit for preferential processing in which a photosensitive material to be preferentially introduced into the conveyance passage and processed is set, among the plurality of setting units.

The seventh aspect lies in the apparatus according to the sixth aspect described above, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

The eighth aspect lies in the apparatus according to any one of the aspects 3–5 described above, further comprising a plurality of setting units capable of setting photosensitive materials to be introduced into the conveyance passage and processed respectively, and a processing order control means for preferentially introducing a set photosensitive material into the conveyance passage to perform processing when the photosensitive material is set in a predetermined and specified setting unit.

According to the first aspect described above, photosensitive materials are guided by the pairs of guide members on both sides, and conveyed on the serial conveyance passage while being prevented from meander and curling, and the development processing steps are successively performed. The conveyance passage is divided into a plurality of blocks. The spacing distance between the pair of guide members is changeable in each of the blocks. The guide members in each of the blocks are subjected to enlargement or reduction by changing the spacing distance in response to introduction of forward ends of photosensitive materials having different widthwise dimensions. Thus it is possible to feed a subsequent photosensitive material having a widthwise dimension different from that of a preceding photosensitive material to the processing apparatus before discharge of a backward end of the preceding photosensitive material precedently introduced into the conveyance passage. Therefore, deterioration of the processing ability can be restrained even when photosensitive materials having different widthwise dimensions are alternately processed, as compared with the conventional apparatus in which a subsequent photosensitive material cannot be introduced into the conveyance passage before discharge of an entire preceding photosensitive material from the conveyance passage.

According to the second aspect described above, the enlargement or reduction of the spacing distance between the guide members in each of the blocks is successively performed by using an identical driving source from upstream to downstream blocks in accordance with movement of photosensitive materials. Thus the spacing distance between the guide members in each of the blocks can be enlarged or reduced by driving the single driving source, enabling simple and assured driving by using a small number of components.

According to the third aspect described above, photosensitive materials are conveyed from upstream to downstream sides on the serial conveyance passage while successively guiding them on their both sides by using a large number of the pairs of guide members. The spacing distance changing means changes the spacing distances between the guide members of the pairs in each of the blocks with provision of phase differences in accordance with arrival at each of the blocks of a forward end of a photosensitive material having a widthwise dimension different from that of a preceding photosensitive material. Thus the distances between the guide members of the pairs in each of the blocks are successively changed from upstream to downstream sides in accordance with movement of photosensitive materials having different widthwise dimensions.

Therefore, it is possible to feed a subsequent photosensitive material having a widthwise dimension different from that of a preceding photosensitive material to the processing apparatus before discharge of a backward end of the preceding photosensitive material precedently introduced into the conveyance passage. It is possible to shorten the interval between the backward end of the preceding photosensitive material and a forward end of the following photosensitive material as compared with the conventional apparatus. Accordingly, efficiency of the processing can be maintained even when photosensitive materials having different widthwise dimensions are alternately processed.

The spacing distance changing means can be constructed, for example, as described in the fourth aspect, such that a plurality of cams for changing the spacing distances between the guide members of the pairs are provided to correspond to each of the pairs of guide members, the cams are allowed to have different phases for the guide members in each of the blocks, and they are simultaneously driven by an identical driving source with phase differences. Thus the spacing distances between the guide members of the pairs in each of the blocks can be successively changed from upstream to downstream sides of the conveyance passage in accordance with movement of photosensitive materials having different widthwise dimensions by driving the single driving source. Accordingly, simple and assured driving can be performed by using a small number of components.

It is possible to construct a system in which the driving force is transmitted from the identical driving source described in the second and fourth aspects to the guide members and cams as defined in claim 4 or the like through various driving force transmitting means such as gears, chains, and clutches.

In the present invention, it is unnecessary to change the spacing distance between the guide members of the pair in each of the blocks when photosensitive materials having an identical widthwise dimension are continuously processed. Therefore, the processing can be continuously performed by providing a fairly short and constant interval between a backward end of a preceding photosensitive material and a forward end of a following photosensitive material conveyed on the conveyance passage.

On the contrary, when a preceding photosensitive material has a wide widthwise dimension (hereinafter referred to as "wide width"), and a following photosensitive material has a narrow widthwise dimension (hereinafter referred to as "narrow width"), it is impossible to change the spacing distance between the guide members of the pair in a predetermined block into a spacing distance corresponding to the following narrow width photosensitive material in a state in which a backward end of the preceding wide width photosensitive material is present in the predetermined block. Accordingly, it is necessary to adjust the interval between the backward end of the preceding photosensitive material and a forward end of the following photosensitive material conveyed on the conveyance passage so that the forward end of the following narrow width photosensitive material arrives at the predetermined block after the backward end of the preceding wide width photosensitive material is discharged from the predetermined block.

On the other hand, when a preceding photosensitive material has a narrow width, and a following photosensitive material has a wide width, the preceding narrow width photosensitive material is conveyed on the conveyance passage reliably provided that the preceding photosensitive material extends over a plurality of blocks, and a portion of not less than a predetermined length of a forward end of the preceding photosensitive material is guided by pairs of guide members allowed to have a spacing distance corresponding to the narrow width, even if the spacing distance between the pairs of guide members in a predetermined block in which a backward end of the preceding narrow width photosensitive material exists is changed to a spacing distance corresponding to the following wide width photosensitive material before discharge of the backward end of the preceding narrow width photosensitive material from the predetermined block, and if the following wide width photosensitive material is introduced into the predetermined block.

As described above, the minimum interval between the backward end of the preceding photosensitive material and the forward end of the following photosensitive material conveyed on the conveyance passage differs depending on the combination of the widthwise dimension of the photosensitive material precedently introduced into the conveyance passage and processed and the widthwise dimension of the photosensitive material subsequently introduced into the conveyance passage and processed. Thus the invention as defined in the fifth aspect further comprises the conveyance control means for comparing a widthwise dimension of a preceding photosensitive material precedently introduced into the conveyance passage and processed with a widthwise dimension of a following photosensitive material subsequently introduced into the conveyance passage and processed, and changing a minimum interval between a backward end of the preceding photosensitive material and a forward end of the following photosensitive material conveyed on the conveyance passage in accordance with a result of the comparison.

Thus the minimum interval described above is changed to a proper size in accordance with a combination of the widthwise dimension of the preceding photosensitive material and the widthwise dimension of the following photosensitive material. Therefore, the ability for processing photosensitive materials can be further improved as compared with a system in which the minimum interval between a preceding photosensitive material and a following photosensitive material is previously set to be long in a fixed manner so that no trouble arises in any combination of a widthwise dimension of the preceding photosensitive material and a widthwise dimension of the following photosensitive material.

The minimum interval between the backward end of the preceding photosensitive material and the forward end of the following photosensitive material is minimized when photosensitive materials having an identical widthwise dimension are continuously processed in the present invention as well. Therefore, in order to further improve the processing ability in the present invention, it may be assumed that the number of times for changing the spacing distance between the pair of guide members is made as small as possible. However, when a large number of photosensitive materials are processed, there is a possibility of occurrence of a situation in which a specified photosensitive material should be preferentially processed even if the processing efficiency is deteriorated a little.

Thus it is preferable, as also described in the sixth aspect, to further provide a plurality of setting units capable of setting photosensitive materials to be introduced into the conveyance passage and processed respectively, and a designating means for designating a setting unit for preferential processing with setting of a photosensitive material to be preferentially introduced into the conveyance passage and processed among the plurality of setting units. According to this aspect, if there is any photosensitive material to be preferentially processed, the apparatus for processing photosensitive materials recognizes it, and the photosensitive material can be preferentially processed.

As also described in the seventh aspect, it is preferable to further provide a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among the photosensitive materials set in each of the setting units when no preferential setting unit is designated. The condition described above includes, for example, the spacing distance between the pair of guide members, temperatures of processing solutions, and agitation conditions.

According to the aspect described above, if there is any photosensitive material to be preferentially processed, the photosensitive material is preferentially introduced into the conveyance passage and processed. If there is no photosensitive material to be preferentially processed, the photosensitive material capable of being introduced into the conveyance passage is preferentially processed in a short interval with respect to a preceding photosensitive material with no necessity to change various conditions such as the spacing distance between the pair of guide members. Therefore, if there is no photosensitive material to be preferentially processed, other photosensitive materials can be efficiently processed.

As also described in the eighth aspect, a plurality of setting units are provided in the same manner as described above, and a processing order control means is provided for preferentially introducing a set photosensitive material into the conveyance passage to perform processing when the photosensitive material is set in a predetermined and specified setting unit. By doing so, it becomes unnecessary for an operator to designate the setting unit with setting of the photosensitive material to be preferentially processed by using the designating means. Thus labor saving can be realized.

As for the blocks in the present invention, each of a plurality of processing tanks for performing development processing steps may be used as a minimum unit for the division into blocks, or each of the plurality of guide members provided along the conveyance passage may be used as a minimum unit for the division into blocks. However, it is preferable from a viewpoint of improvement in processing ability to divide the conveyance passage into a plurality of blocks so that the time for the photosensitive material to pass through each of the blocks is as uniform as possible.

BRIEF DESCRIPTION OF THE DRAWINGS

FIG. 13B shows a flow chart illustrating processing steps of control for changing the guide width in the second embodiment.

DESCRIPTION OF THE PREFERRED EMBODIMENTS

Figure 1:
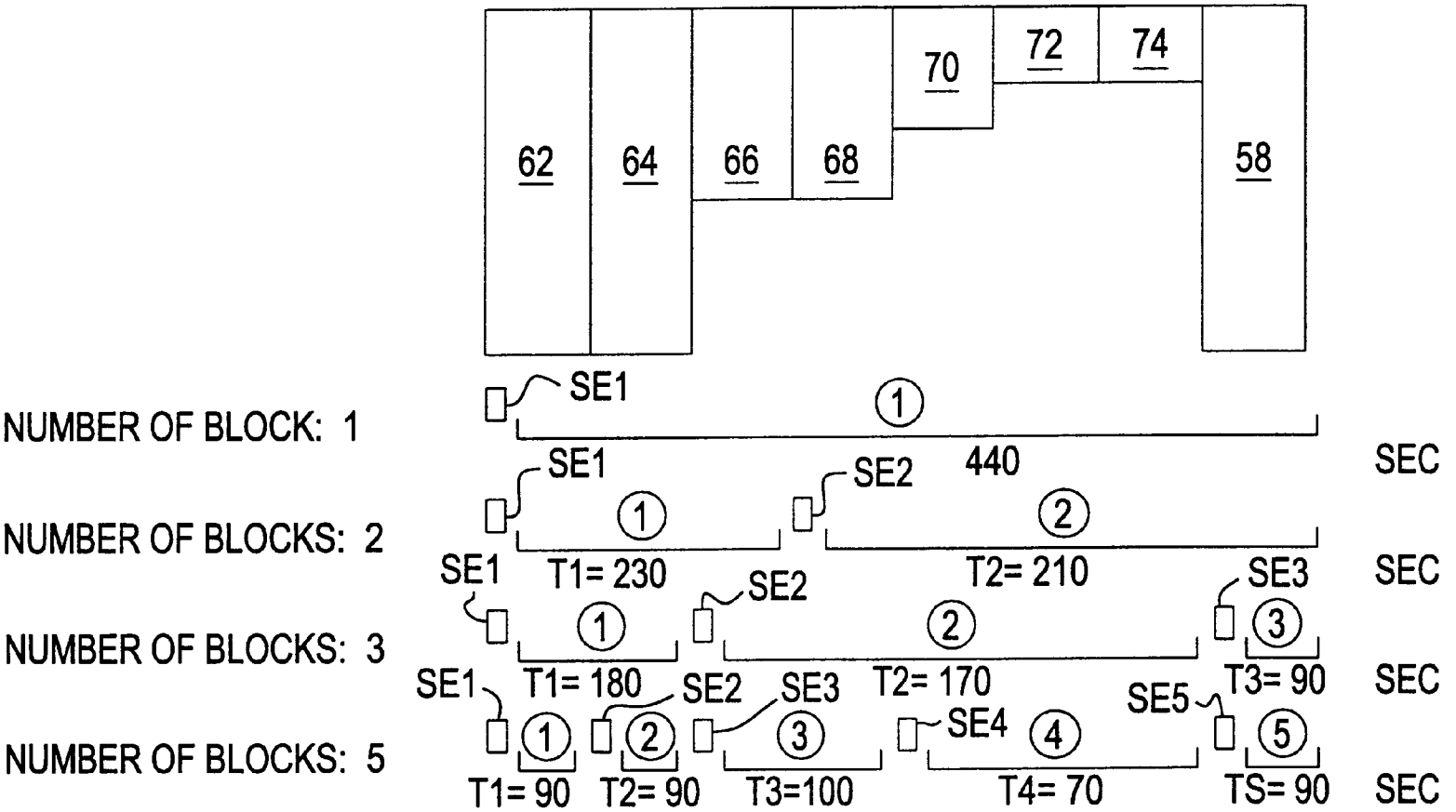
FIG. 1 shows an explanatory diagram for illustrating a control method according to an embodiment of the present invention.

Embodiments of the present invention will be described in detail below with reference to the drawings. However, the present invention is not limited to the numerical values of the embodiments.

First Embodiment

The first embodiment of the present invention will be explained with reference to FIGS. 1–9. As shown in FIG. 2, a processing apparatus for photographic printing (a printer processor) as one type of the apparatus for processing photosensitive materials includes a printing section 54 for drawing a photosensitive material from a magazine 52 containing the photosensitive material (color paper) 78 in a roll form and printing images recorded on a developed negative film or the like, a development processing section 56 for performing various processing steps such as development and drying of the photosensitive material 78 with images printed thereon, and a cutting section 60 for cutting the photosensitive material 78 after drying into prints having a predetermined size for every frame.

The printing section 54 is provided with a cutter 50 for cutting the photosensitive material after every predetermined number of images such as a number of prints corresponding to one order after printing images on the photosensitive material. A reservoir section 51 for temporarily reserving the photosensitive material is provided on a downstream side from the cutter 50. The photosensitive material fed into the reservoir section 51 forms a buffer loop, and then is wound around a winding roller 53, and conveyed to the development processing section 56.

The development processing section 56 is provided with a color development processing tank 62, a color development processing tank 64, a bleaching fixation processing tank 66, a fixation processing tank 68, a washing processing tank 70, a stabilization processing tank 72, and a stabilization processing tank 74 in series in an order from a left side in FIG. 2. Each of processing solutions such as a developing solution is stored in each of the tanks. Guide racks 76 are detachably hung in each of the processing tanks 62–74. The photosensitive material 78 is guided into the processing solutions in the processing tanks 62–74 by the guide racks 76 after exposure.

Figure 6:
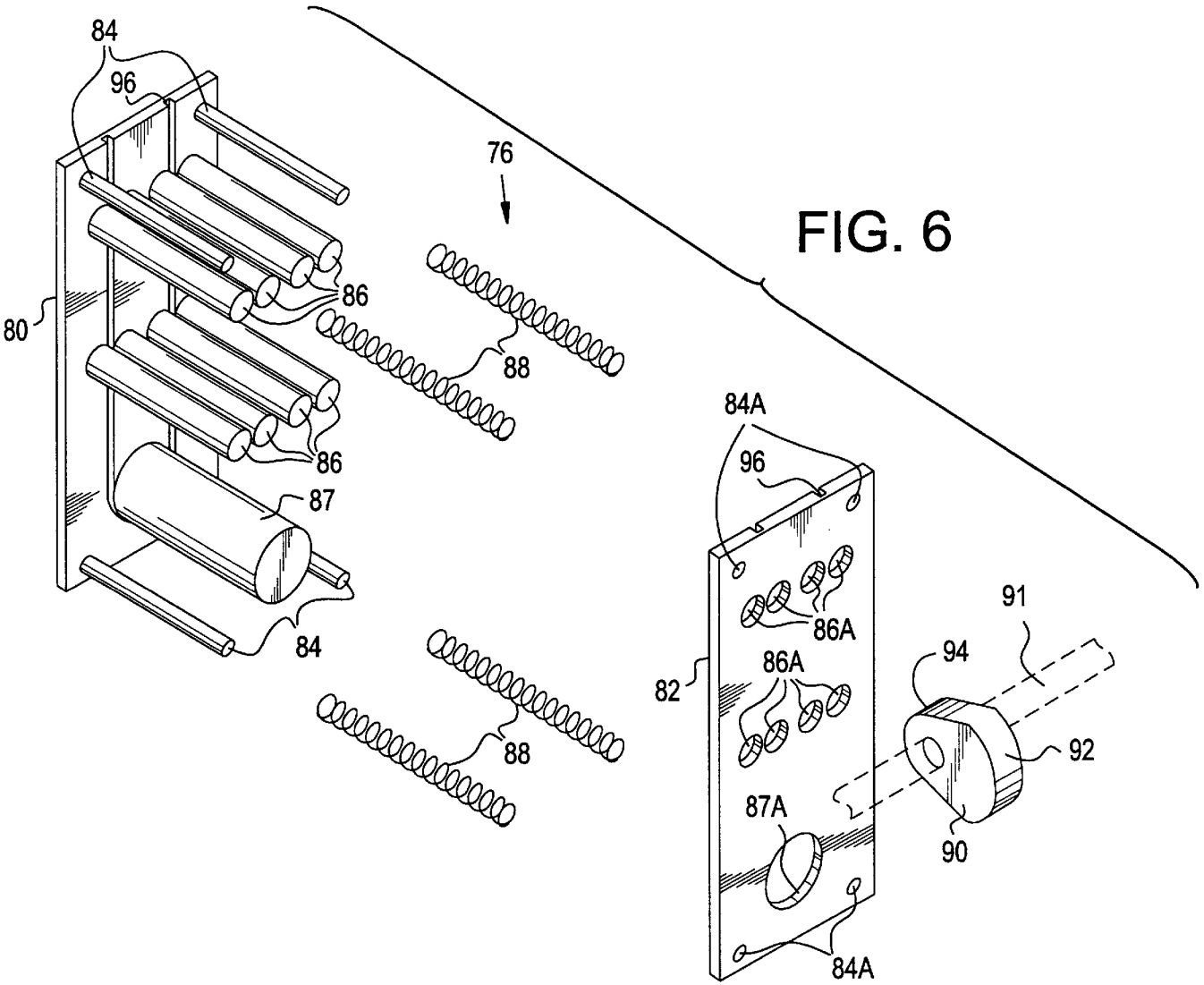
FIG. 6 shows an exploded perspective view illustrating a guide rack for the apparatus of the embodiment.
Figure 8:
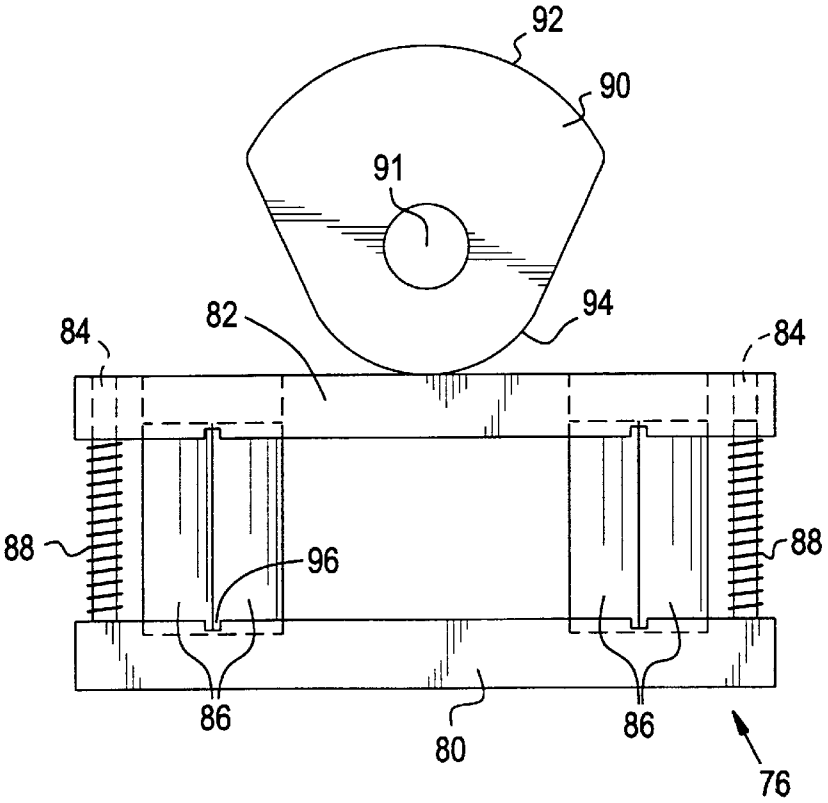
FIG. 8 shows a plan view illustrating a state in which the width of the conveyance passage in the guide rack shown in FIG. 7 of the embodiment is switched to a wide width.
Figure 7:
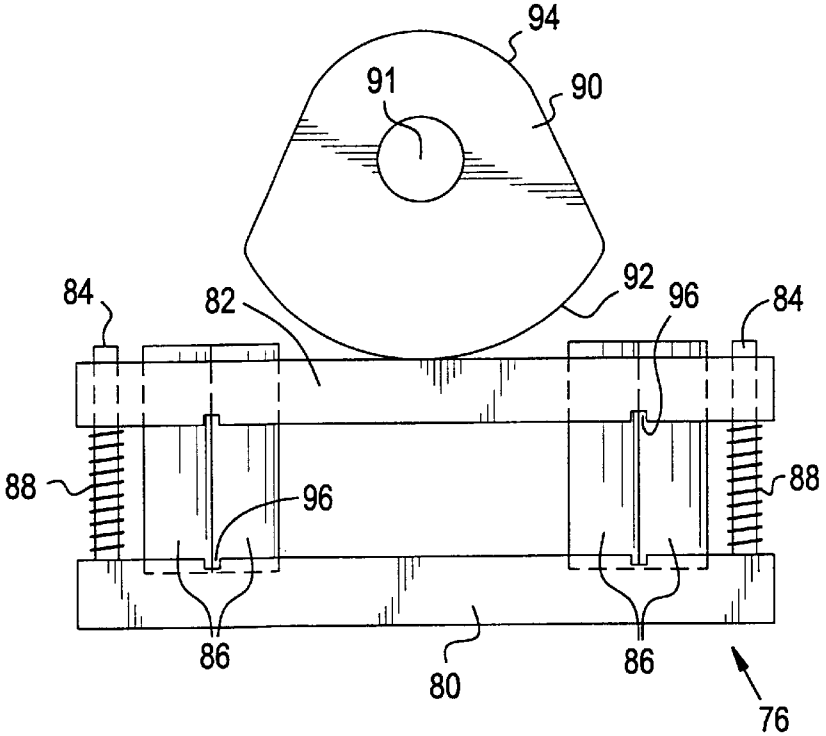
FIG. 7 shows a plan view illustrating a state in which the width of a conveyance passage in the guide rack of the apparatus of the embodiment is switched to a narrow width.

The guide racks 76 guide the lengthy and band-shaped photosensitive material 78 so that it is conveyed through each of the processing tanks along a U-shaped conveyance passage. As shown in FIGS. 6–8, the guide rack 76 is provided with two rack side plates 80, 82 for guiding the photosensitive material 78 with slidable contact with both side edge portions thereof when the photosensitive material 78 is conveyed in its longitudinal direction.

In the guide rack 76, as shown in FIGS. 6 and 7, the first rack side plate 80 is fixedly arranged, and the second rack side plate 82 is movable in directions toward and away from the first rack side plate 80. A plurality of guide rods 84 for guiding movement of the rack side plate 82 with respect to the rack side plate 80 are implanted in parallel to each other on the rack side plate 80 on the fixed side. First ends of a plurality of pairs of guide rollers 80 and a turnover roller 87 are rotatably supported at a plurality of predetermined positions along the conveyance passage so that they do not fall off of the rack side plate 80 on the fixed side. The first ends are coupled to a roller driving source (not shown) through chains or the like respectively, and they are driven at constant peripheral speeds to convey the photosensitive material.

Through holes 84A for the guide rods 84 to penetrate, and shaft holes 86A, 87A for rotatably supporting the guide rollers 86 and the turnover roller 87 slidably in their axial directions are provided at predetermined positions of the second rack side plate 82. Each of the guide rods 84 is inserted into a compressive coil spring 88 respectively. As shown in FIG. 6, the guide rods 84 are inserted into the through holes 84A of the second rack side plate 82 at their intermediate portions, and the guide rollers 86 and the turnover roller 87 are inserted into the shaft holes 86A, 87A in the vicinity of their second ends. Thus the rack side plate 80 and the rack side plate 82 are assembled so that they are parallel to one another.

A cam member 90 is arranged so that it abuts against an outer surface of the rack side plate 82. The cam member 90 is rotated by rotating its main shaft 91 by a motor 191 (FIG. 11) as a driving source (not shown). The arrangement is made such that the second rack side plate 82 is moved between an approached position shown in FIG. 7 and a separated position shown in FIG. 8 with respect to the first rack side plate 80.

The state shown in FIG. 7 illustrates a state in which rotation of the main shaft 91 allows a circular arc portion 92 having a large diameter of the cam member 90 to press the second rack side plate 82 in a direction toward the first rack side plate 80 against the urging force of the compressive coil springs 88 to set a conveyance passage for a narrow width photosensitive material 78. In accordance with rotation of the cam member 90, a state shown in FIG. 8 is achieved, in which a circular arc portion 94 having a small diameter abuts against the second rack side plate 82 to set a conveyance passage for a wide width photosensitive material 78. During this operation, the second rack side plate 82 is pressed by the urging force of the compressive coil springs 88 toward the side of the cam member 90, and it is separated from the first rack side plate 80. In the case of movement from the state shown in FIG. 8 to the state shown in FIG. 7, the second rack side plate 82 is moved in accordance with rotation of the cam member 90 toward the first rack side plate 80 while compressing the compressive coil springs 88. Thus the spacing distance between the pair of rack side plates can be enlarged and reduced by rotation of the cam member 90.

U-shaped guide grooves 96 are engraved in opposing side surfaces of each of the rack side plate 80, 82 along the conveyance passage for photosensitive materials 78 set by the guide rollers 86 respectively. The surface of the fixedly arranged rack side plate 80 opposing to the rack side plate 82 is used as a reference position, and the photosensitive material 78 is conveyed so that one end in the widthwise direction approximately coincides with the reference position described above irrelevant to its dimensions in the widthwise direction. Both sides of the photosensitive material 78 enter the guide grooves 96 to guide for the conveying operation for the photosensitive material 78. Instead of the guide grooves, or in addition to the guide grooves 96, it is possible to apply various guide plates and the like for guiding the photosensitive material 78.

The guide racks 76 for each of the processing tanks 62–74 have the same structure except for the number of the guide rollers 86 to be rotatably supported. The spacing distance between the side plates can be changed in the same manner in accordance with widthwise dimensions of photosensitive materials to be conveyed. On downstream sides from each of the processing tanks 62–74, rollers 62A–74A are rotatably supported respectively for squeezing processing solutions adhered to the photosensitive material 78 going to the next processing tank or the drying section, and for guiding the photosensitive material 78. The cams 90 for driving the side plates 82 in the guide racks 76 in each of the processing tanks are all coupled to the identical main shaft 91, and they are simultaneously rotated by the motor 191 (see FIGS. 6 and 11). However, these cams have mutually different attachment positions around the shaft to the main shaft 91, namely different phases for each of blocks described below.

The drying section 58 is arranged adjacent to the stabilization processing tank 74 in the development processing section 56. In the drying section 58, the photosensitive material 78 taken out from the stabilization processing tank 74 passes through squeeze rollers 74A, and then the photosensitive material is dried by blowing it with warm air while being wound around a rotary drum 59. Although not illustrated, the drying section 58 is also provided with the guide rack 76 in which the spacing distance between the pair of rack side plates can be enlarged and reduced in the same manner as the other processing tanks. The photosensitive material 78 is blown with the warm air between each of the rollers.

Figure 2:
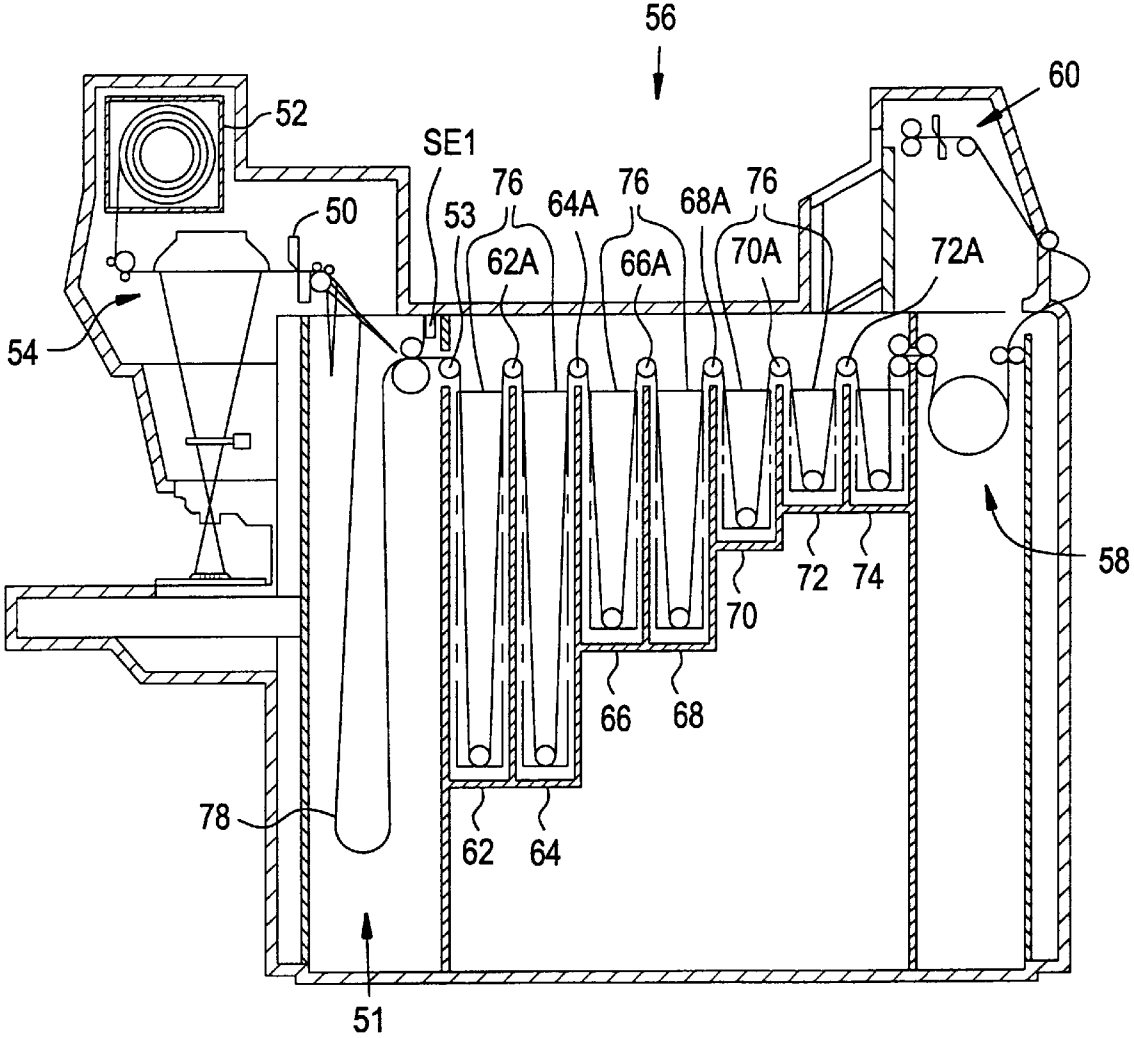
FIG. 2 shows a schematic arrangement illustrating an apparatus for processing photosensitive materials of the embodiment.

In this embodiment, the conveyance passage for the photosensitive material from a photosensitive material incoming side of the color development processing tank 62 of the development processing section 56 to a photosensitive material outgoing side of the drying section 58 is divided, for example, as shown as "number of blocks :3" in FIG. 1, into three blocks in total comprising Block 1 (shown as (1) in FIG. 1) from the photosensitive material incoming side of the color development processing tank 62 to a photosensitive material outgoing side of the color development processing tank 64, Block 2 (shown as (2) in FIG. 1) from a photosensitive material incoming side of the bleaching fixation processing tank 66 to a photosensitive material outgoing side of the stabilization processing tank 74, and Block 3 (shown as (3) in FIG. 1) from a photosensitive material incoming side to the photosensitive material outgoing side of the drying section 58.

Sensors SE1 to SE3 for detecting passage of the photosensitive material 78 are arranged at photosensitive material inlet portions of each of the blocks of Blocks 1–3 respectively. For example, infrared sensors can be used as the sensors. The sensor SE1, which is arranged on the photosensitive material incoming side of Block 1, also has a function to distinguish whether the photosensitive material 78 has a wide width or a narrow width. The position of the sensor SE1 is not limited to the position described above, it may be installed at another position such as in the printing section 54. Whether the photosensitive material has a wide width or a narrow width 78 may be distinguished by reading identification codes such as bar codes provided on the magazine 52, or by using printing information such as a mask size used in the printing section 54.

Figure 11:
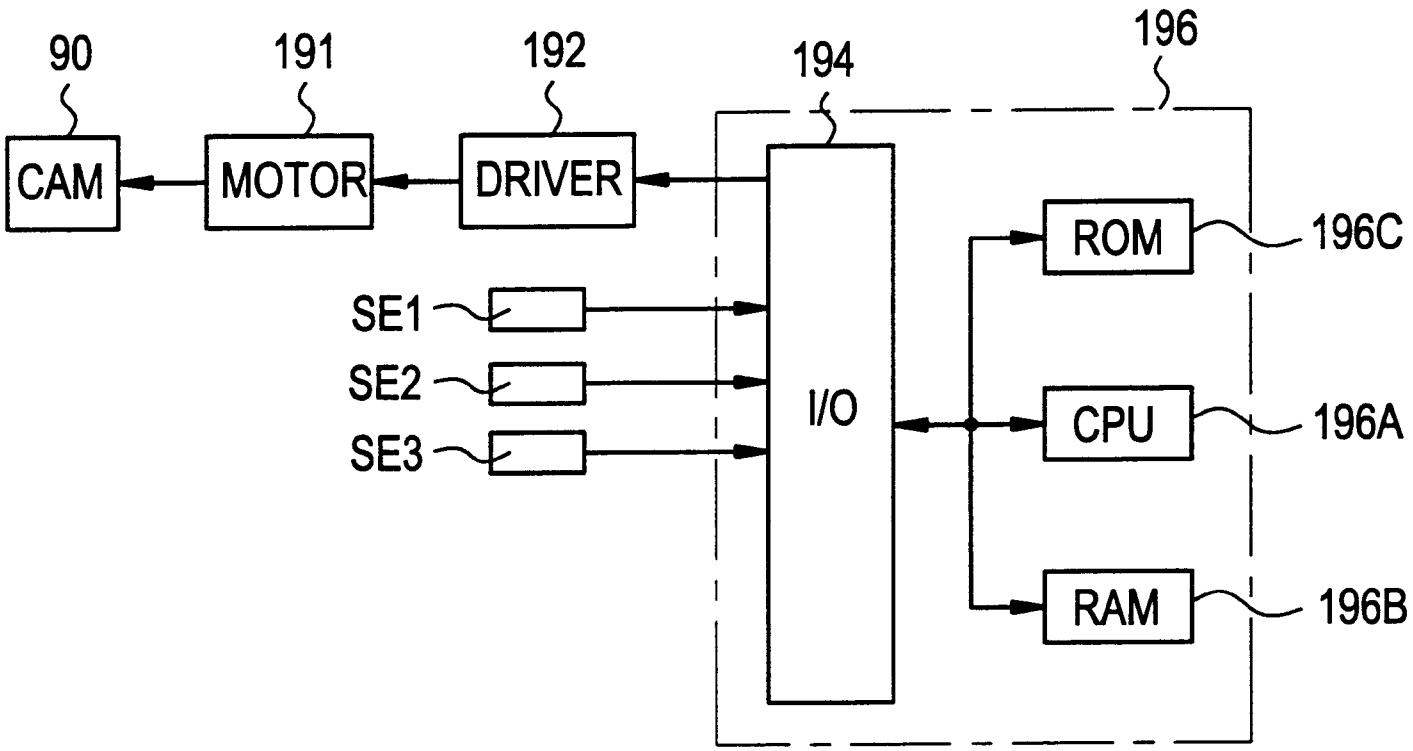
FIG. 11 shows a block diagram illustrating a control unit used in the embodiment.

As shown in FIG. 11, the sensors SE1 to SE3 are connected to an I/O port 194 of a control unit 196 respectively, and they outputs signals for representing detection results to the control unit 196 respectively. The control unit 196 is constructed, for example, by a microcomputer, comprising a central processing unit (CPU) 196A, a random access memory (RAM) 196B, and a read only memory (ROM) 196C. A motor 191 as the driving source is connected to the I/O port 194 through a driver 192. The driving of the motor 191 is controlled by the control unit 196.

Figure 3:
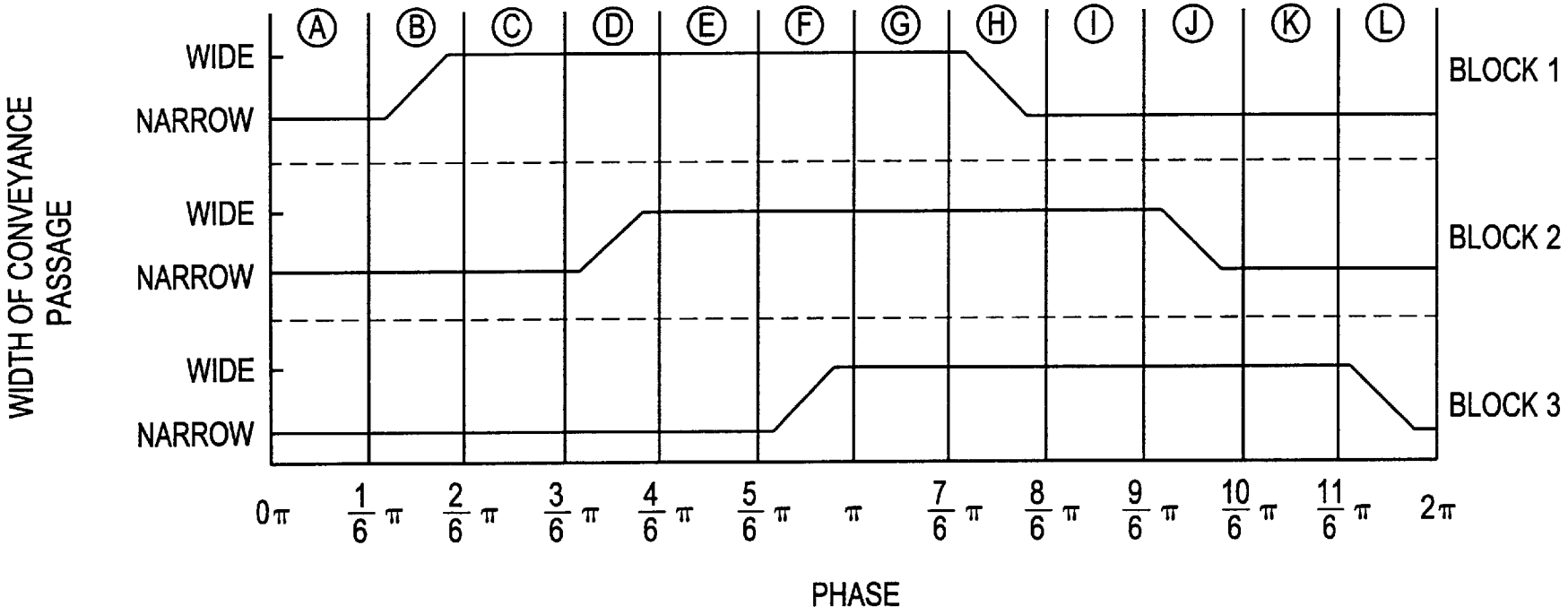
FIG. 3 shows an explanatory diagram illustrating a control method in which processing steps for processing photosensitive materials in the embodiment are divided into three blocks.

The motor 191 has its driving shaft which is coupled to the main shaft 91 of the cam members 90. A plurality of the cam members 90, which are provided corresponding to the guide racks 76 arranged in each of the processing tanks and the drying section 58 respectively, have different phases for each of the blocks, as also shown in FIG. 3. In FIG. 3, the phase of the cam members 90 of each of Blocks 1, 2, 3 is divided into a plurality of intervals at every $\pi/6$. Symbols A to L are appended to states of the cam members 90 in each of the intervals to make distinction. When the main shaft 91 is rotated by the motor 191, the phase of each of the cam members 90 changes, and the state successively changes in accordance with the rotation angle of the main shaft 91. As also shown in FIG. 3, the conveyance passage width (the spacing distance between the rack side plates 80, 82) in each of the blocks successively changes with a certain phase difference from the narrow width to the wide width or from the wide width to the narrow width.

Figure 12A:
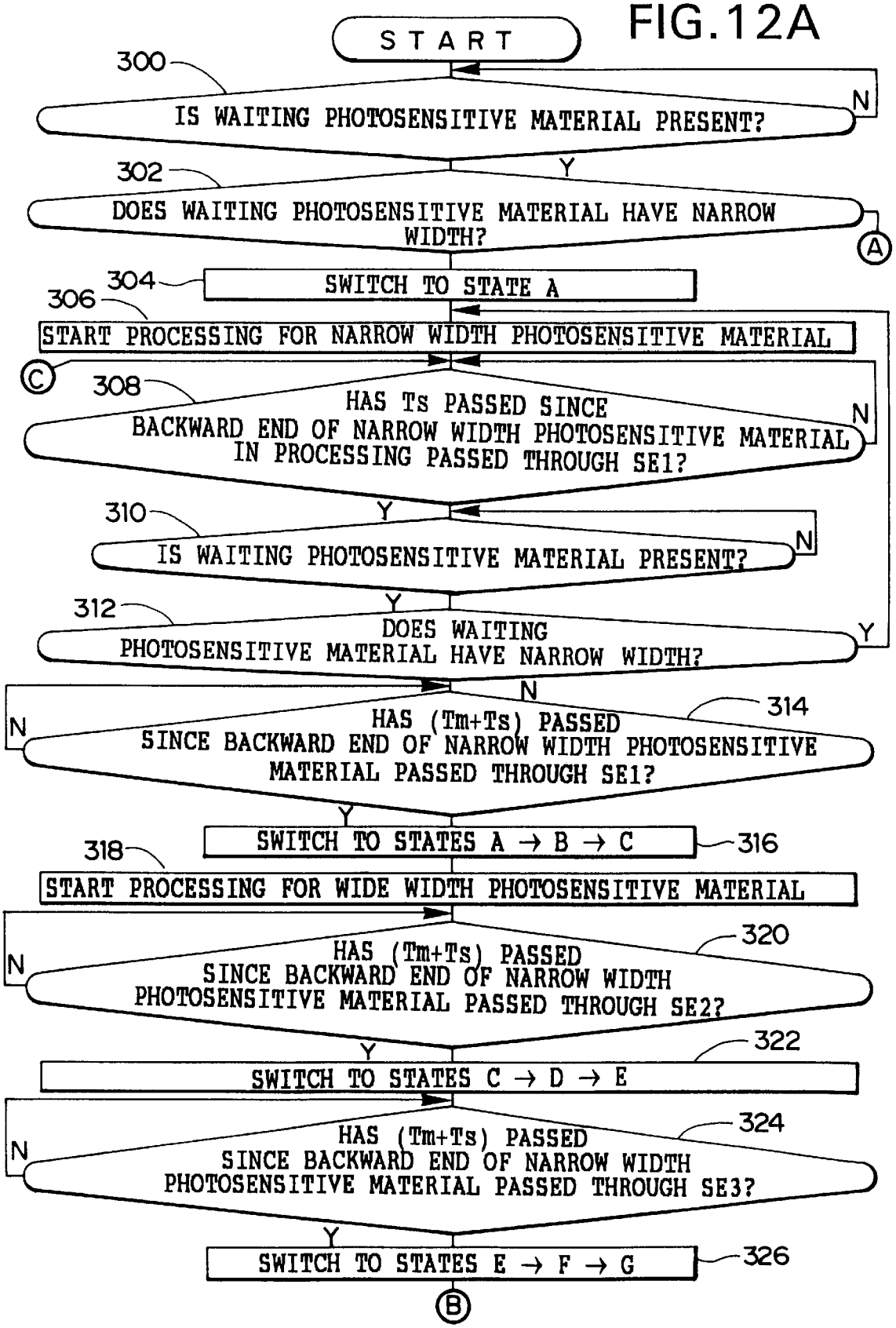
FIG. 12A shows a flow chart illustrating processing steps of control for changing the guide width in the first embodiment.
Figure 12B:
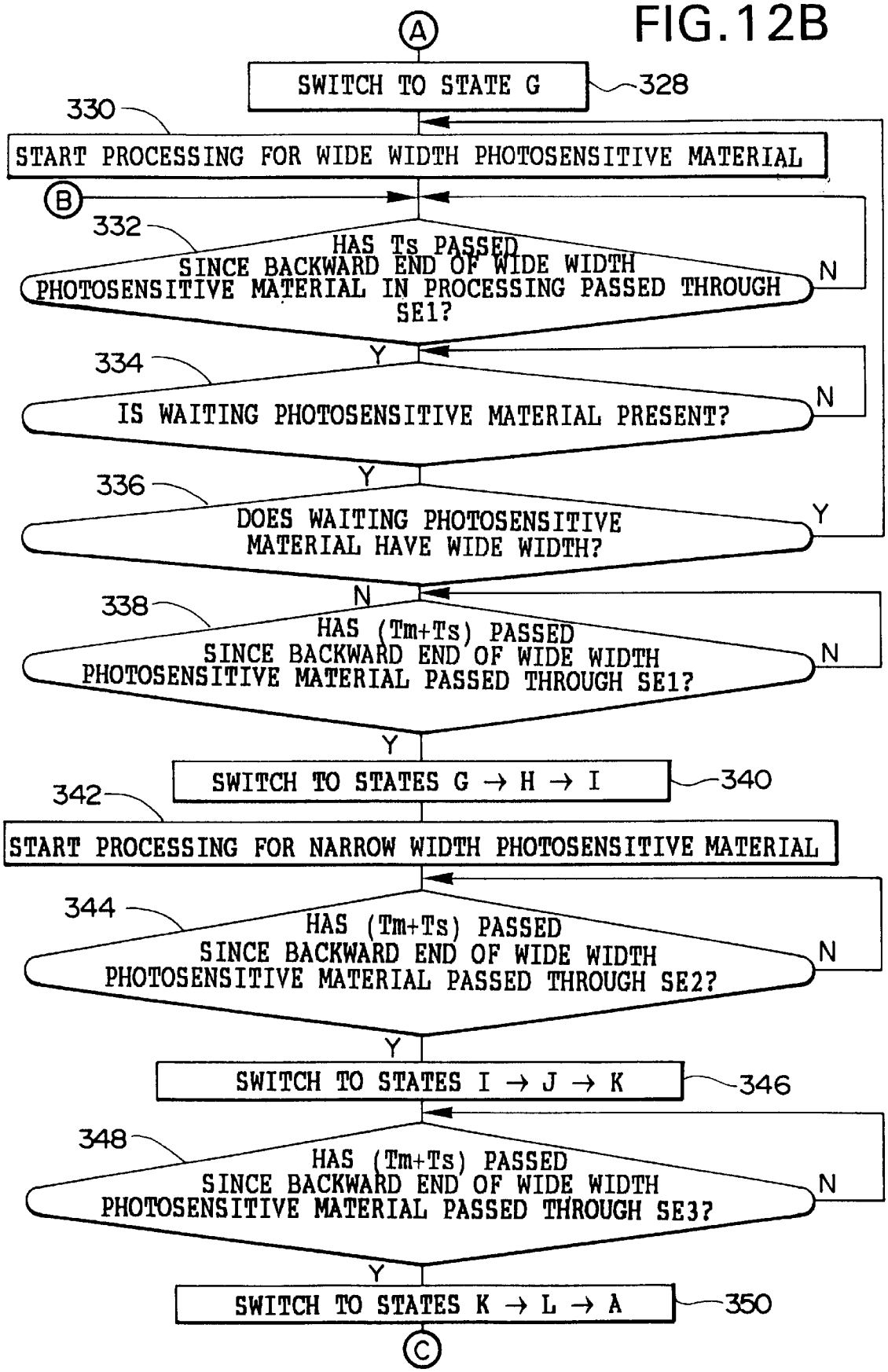
FIG. 12B shows a flow chart illustrating processing steps of control for changing the guide width in the first embodiment.

Next, processing steps of control for changing the guide width performed in the control unit 196 will be explained with reference to flow charts in FIGS. 12A and 12B. The processing steps shown in FIGS. 12A and 12B are executed in the control unit 196 when the main power source for the processing apparatus for photograph printing is turned on.

In a step 300, it is judged whether or not any photosensitive material waiting for processing is present. If the judgment is affirmed, it is judged in a step 302 whether or not the widthwise dimension of the waiting photosensitive material is a narrow width. If the judgment is affirmed, the motor 191 is driven to rotate the main shaft 91 in a step 304, and the state of each of the cam members 90 is switched to the state A. In the state A, the circular arc portion 92 having the large diameter size of each of the cam members 90 abuts against the rack side plate 82 respectively. As also clarified from FIG. 3, the spacing distance between the rack side plates 80, 82 (hereinafter referred to as "guide width") in Blocks 1–3 is made to have a size corresponding to the narrow width photosensitive material.

In the next step 306, conveyance of the waiting narrow width photosensitive material begins. Thus the waiting narrow width photosensitive material is successively fed to Block 1, and a series of processing steps are successively performed in each of the processing tanks in Block 1. In a step 308, it is judged whether or not a predetermined time Ts has passed since a backward end of the preceding narrow width photosensitive material in processing passed through the arrangement site of the sensor SE1 (or since it entered Block 1), and the routine waits until the predetermined time Ts passes. The predetermined time Ts is a minimum processing interval for a plurality of photosensitive materials continuously processed in the photograph processor (or a minimum time interval between a backward end of a preceding photosensitive material and a forward end of a following photosensitive material).

If the judgment in the step 308 is affirmed, the routine proceeds to a step 310 to judge whether or not any waiting photosensitive material is present. If the judgment is affirmed, it is judged in a step 312 whether or not the waiting photosensitive material has a narrow width. If the judgment in the step 312 is affirmed, the routine returns to the step 306 to start conveyance of the waiting narrow width photosensitive material. Therefore, when narrow width photosensitive materials are continuously processed, they are continuously processed with separation by the minimum processing interval Ts while maintaining the state A.

On the other hand, if the waiting photosensitive material has a wide width, the judgment in the step 312 is negated, and the routine proceeds to a step 314. It is judged in the step 314 whether or not a time corresponding to a sum of the predetermined time Ts and a predetermined time Tm has passed since the backward end of the preceding narrow width photosensitive material in processing passed through the arrangement site of the sensor SE1 (or since it entered Block 1), and the routine waits until the judgment is affirmed. The predetermined time Tm is defined by the following expression (1).

$$Tm=\max(T1, T2, \ldots, Tn) \quad (1)$$

wherein n: total number of Blocks; Tn: processing time for a photosensitive material in Block n; max ( ): operator for representing selection of a maximum value among a plurality of numerical values in parentheses.

When the judgment in the step 314 is affirmed, the backward end of the preceding narrow width photosensitive material has already passed through Block 1. A period of time of not less than the predetermined time Ts has passed since the backward end entered Block 2. Thus the motor 191 is driven to rotate the main shaft 91 in a step 316, and the state of each of the cam members 90 is switched from the state A through the state B to the state C.

In the state C, the cam members 90 in Block 1 abut against the rack side plates 82 with the circular arc portions 94 having the small diameter size, and the cam members 90 in Blocks 2, 3 abut against the rack side plates 82 with the circular arc portions 92 having the large diameter size. As also clarified from FIG. 3, the guide width in Block 1 is allowed to have a size corresponding to the wide width photosensitive material, and the guide width in Blocks 2, 3 is allowed to have a size corresponding to the narrow width photosensitive material.

In a step 318, conveyance of the waiting wide width photosensitive material begins. Thus the following wide width photosensitive material is fed to Block 1 in which the guide width has been made to have the widthwise dimension corresponding to the wide width, and the processing is started. Therefore, when the widthwise dimension of the photosensitive material to be processed is switched from the narrow width to the wide width, the processing for the following wide width photosensitive material is started at a processing interval of Ts+Tm. As described above, the interval between the backward end of the preceding photosensitive material and the forward end of the following photosensitive material is changed in the processing described above in accordance with whether or not the widthwise dimension of the following photosensitive material is equal to the widthwise dimension of the preceding photosensitive material. This feature corresponds to the conveyance control means in the fifth aspect described above.

In the next step 320, it is judged whether or not the time corresponding to Ts+Tm has passed since the backward end of the preceding narrow width photosensitive material passed through the arrangement site of the sensor SE2 (or since it entered Block 2), and the routine waits until the judgment is affirmed. When the judgment in the step 320 is affirmed, the backward end of the preceding narrow width photosensitive material has already passed through Block 2. A period of time of not less than the predetermined time Ts has passed since the backward end entered Block 3. Thus the motor 191 is driven to rotate the main shaft 91 in a step 322, and the state of each of the cam members 90 is switched from the state C through the state D to the state E.

In the state E, the cam members 90 in Blocks 1, 2 abut against the rack side plates 82 with the circular arc portions 94 having the small diameter size, and the cam member 90 in Block 3 abuts against the rack side plate 82 with the circular arc portion 92 having the large diameter size. As also clarified from FIG. 3, the guide width in Blocks 1, 2 is allowed to have a size corresponding to the wide width photosensitive material, and the guide width in Block 3 is allowed to have a size corresponding to the narrow width photosensitive material. The following wide width photosensitive material is fed to Block 2 after the guide width in Block 2 is changed to the size corresponding to the wide width photosensitive material.

In a step 324, it is judged whether or not the time corresponding to TS+Tm has passed since the backward end of the preceding narrow width photosensitive material passed through the arrangement site of the sensor SE3 (or since it entered Block 3), and the routine waits until the judgment is affirmed. When the judgment in the step 324 is affirmed, the backward end of the preceding narrow width photosensitive material has already passed through Block 3. A period of time of not less than the predetermined time Ts has passed since the backward end exited from Block 3. Thus the routine proceeds to a step 326, the motor 191 is driven to rotate the main shaft 91, and the state of each of the cam members 90 is switched from the state E through the state F to the state G. After that, the routine proceeds to a step 332.

In the state G, the cam members 90 in Blocks 1–3 abut against the rack side plates 82 with the circular arc portions 94 having the small diameter size. As also clarified from FIG. 3, the guide width in each of Blocks 1, 2, 3 is allowed to have a size corresponding to the wide width photosensitive material. The following wide width photosensitive material is fed to Block 3 after the guide width in Block 3 is changed to the size corresponding to the wide width photosensitive material.

If it is judged in the step 302 that the widthwise dimension of the waiting photosensitive material is a wide width, each of the cam members 90 is switched to the state G in a step 328 in the same manner as described above, and processing for the waiting wide width photosensitive material is started in a step 330. After that, the routine proceeds to a step 332.

In the step 332, it is judged whether or not the predetermined time Ts has passed since the backward end of the wide width photosensitive material in processing passed through the arrangement site of the sensor SE1 (or since it entered Block 1), and the routine waits until the predetermined time Ts passes. If the judgment in the step 332 is affirmed, the routine proceeds to a step 334 to judge whether or not any waiting photosensitive material is present. If the judgment is affirmed, it is judged in a step 336 whether or not the waiting photosensitive material has a wide width. If the judgment in the step 336 is affirmed, the routine returns to the step 330 to start conveyance of the waiting wide width photosensitive material. Therefore, when wide width photosensitive materials are continuously processed, they are continuously processed with separation by the minimum processing interval Ts while maintaining the state G.

On the other hand, if the waiting photosensitive material has a narrow width, the judgment in the step 336 is negated, and the routine proceeds to a step 338. It is judged in the step 338 whether or not the time corresponding to Ts+Tm has passed, and the routine waits until the judgment is affirmed. If the judgment in the step 338 is affirmed, the motor 191 is driven to rotate the main shaft 91 in a step 340, and the state of each of the cam members 90 is switched from the state G through the state H to the state I. In the state I, the cam members 90 in Block 1 abut against the rack side plates 82 with the circular arc portions 92 having the large diameter size, and the cam members 90 in Blocks 2, 3 abut against the rack side plates 82 with the circular arc portions 94 having the small diameter size. As also clarified from FIG. 3, the guide width in Block 1 is allowed to have a size corresponding to the narrow width photosensitive material, and the guide width in Blocks 2, 3 is allowed to have a size corresponding to the wide width photosensitive material.

In a step 342, conveyance of the waiting narrow width photosensitive material beings. Thus the following narrow width photosensitive material is fed to Block 1 in which the guide width has been made to have the widthwise dimension corresponding to the narrow width, and the processing is started. Therefore, also when the widthwise dimension of the photosensitive material to be processed is switched from the wide width to the narrow width, the processing for the following narrow width photosensitive material is started at the processing interval of Ts+Tm. As described above, the interval between the backward end of the preceding photosensitive material and the forward end of the following photosensitive material is also changed in the processing described above in accordance with whether or not the widthwise dimension of the following photosensitive material is equal to the widthwise dimension of the preceding photosensitive material. This feature corresponds to the conveyance control means in the fifth aspect described above.

In step 344, it is judged whether or not the time corresponding to Ts+Tm has passed since the backward end of the preceding wide width photosensitive material passed through the arrangement site of the sensor SE2 (or since it entered Block 2), and the routine waits until the judgment is affirmed. When the judgment in the step 344 is affirmed, the motor 191 is driven to rotate the main shaft 91 in a step 346, and the state of each of the cam members 90 is switched from the state I through the state J to the state K. In the state K, the cam members 90 in Blocks 1, 2 abut against the rack side plates 82 with the circular arc portions 92 having the large diameter size, and the cam member 90 in Block 3 abuts against the rack side plate 82 with the circular arc portion 94 having the small diameter size. As also clarified from FIG. 3, the guide width in Blocks 1, 2 is allowed to have a size corresponding to the narrow width photosensitive material, and the guide width in Block 3 is allowed to have a size corresponding to the wide width photosensitive material. The following narrow width photosensitive material is fed to Block 2 after the guide width in Block 2 is changed to the size corresponding to the following narrow width photosensitive material.

In a step 348, it is judged whether or not the time corresponding to Ts+Tm has passed since the backward end of the preceding wide width photosensitive material passed through the arrangement site of the sensor SE3 (or since it exited from Block 2), and the routine waits until the judgment is affirmed. When the judgment in the step 348 is affirmed, the routine proceeds to a step 350, the motor 191 is driven to rotate the main shaft 91, and the state of each of the cam members 90 is switched from the state K through the state L to the state A (the state in which the guide width in each of Blocks 1, 2, 3 is made into the size corresponding to the narrow width photosensitive material). After that, the routine proceeds to a step 308.

As described above, in the foregoing, even when the widthwise dimension of the preceding photosensitive material is different from the widthwise dimension of the following photosensitive material, it is possible to start introduction of the following photosensitive material into the development processing section 56 only by providing the time interval corresponding to Ts+Tm which is extremely shorter than those in the conventional apparatus between the backward end of the preceding photosensitive material and the forward end of the following photosensitive material. Thus the processing ability of the photograph development processor can be greatly improved.

In the foregoing, even when a large number of photosensitive materials including photosensitive materials having different widths are alternately processed, each of the photosensitive materials is always guided with a guide width corresponding to its widthwise dimension over an entire length of the photosensitive material. Thus no conveyance failure or the like occurs in each of the photosensitive materials, and reliable conveyance can be performed.

By the way, in order to improve the processing ability of the apparatus for processing photosensitive materials, it is preferable to set the interval between the backward end of a preceding photosensitive material and the forward end of a following photosensitive material to be as short as possible when the widthwise dimension of the preceding photosensitive material is different from the widthwise dimension of the following photosensitive material. As described above, in this embodiment, the time interval between the backward end of a preceding photosensitive material and the forward end of a following photosensitive material is Ts+Tm when the widthwise dimension of the preceding photosensitive material is different from the widthwise dimension of the following photosensitive material. The predetermined time Tm is a maximum value of processing times for photosensitive materials in each of the blocks. Thus the predetermined time Tm is decreased, and the processing ability of the apparatus for processing photosensitive materials can be improved by increasing the number of blocks obtained by the division, or by determining boundaries between blocks so that the processing time in each of the blocks is made as uniform as possible even when the number of blocks is constant.

For example, as shown in FIG. 1, block division under the following conditions will be explained. The processing time in the color development processing tank 62 (the time for photosensitive materials to move from the winding roller 53 to 62A) is 90 seconds. The processing time in the color development processing tank 64 (the time for photosensitive materials to move from the winding roller 62A to 64A) is 90 seconds. The processing time in the bleaching fixation processing tank 66 (the time for photosensitive materials to move from the winding roller 64A to 66A) is 50 seconds. The processing time in the fixation processing tank 68 (the time for photosensitive materials to move from the winding roller 66A to 68A) is 50 seconds. The processing time in the washing processing tank 70 (the time for photosensitive materials to move from the winding roller 68A to 70A) is 30 seconds. The processing time in the stabilization processing tank 72 (the time for photosensitive materials to move from the winding roller 70A to 72A) is 20 seconds. The processing time in the stabilization processing tank 74 (the time for photosensitive materials to move from the winding roller 72A to 74A) is 20 seconds. The processing time in the drying section 58 (the time for photosensitive materials to move from the winding roller 74A to the cutting section 60) is 90 seconds.

For example, in the case of division into two blocks, the conveyance passage may be divided into two with a boundary between the bleaching fixation processing tank 66 and the fixation processing tank 68. In this procedure, the processing time in former half Block 1 (the processing tanks 62 to 66) is 230 seconds, and the processing time in latter half Block 2 (the processing tank 68 to the drying section 58) is 210 seconds, and the predetermined time Tm is 230 seconds.

In the case of division into three blocks, as also described above, the conveyance passage may be divided with a boundary between the color development processing tank 64 and the bleaching fixation processing tank 66, and a portion before the boundary may be designated as Block 1 (the processing tanks 62–64). Further, the conveyance passage may be divided with a boundary between the stabilization processing tank 72 and the drying section 58, a portion before the boundary may be designated as Block 2 (the processing tanks 66–74), and a portion after the boundary may be designated as Block 3 (the drying section 58). In this procedure, the processing time in Block 1 is 180 seconds, the processing time in Block 2 is 170 seconds, the processing time in Block 3 is 90 seconds, and the predetermined time Tm is 180 seconds.

In the case of division into five blocks, the color development processing tank 62 may be designated as Block 1, the color development processing tank 64 may be designated as Block 2, the bleaching fixation processing tank 66 and the fixation processing tank 68 may be designated as Block 3, the washing processing tank 70, the stabilization processing tank 72, and the stabilization processing tank 74 may be designated as Block 4, and the drying section 58 may be designated as Block 5. In this procedure, the processing time in Block 1 is 90 seconds, the processing time in Block 2 is 90 seconds, the processing time in Block 3 is 10 seconds, the processing time in Block 4 is 70 seconds, the processing time in Block 5 is 90 seconds, and the predetermined time Tm is 90 seconds.

The conveyance passage may be divided such that each of the processing tanks 62, 64, 66, 68, 70, 72, 74, and the drying section 58 constitute single Blocks.

When the conveyance passage is divided with each of the numbers of blocks as described above, the sensors for detecting passage of photosensitive materials may be provided at least at photosensitive material incoming sides in each of the blocks, as shown by the sensors SE1 to SE5 in FIG. 1. Alternatively, sensors may be provided at photosensitive material inlet portions of each of the processing tanks 62–74 and the drying section 58, and they may be appropriately used in different ways in accordance with divided blocks.

Figure 4:
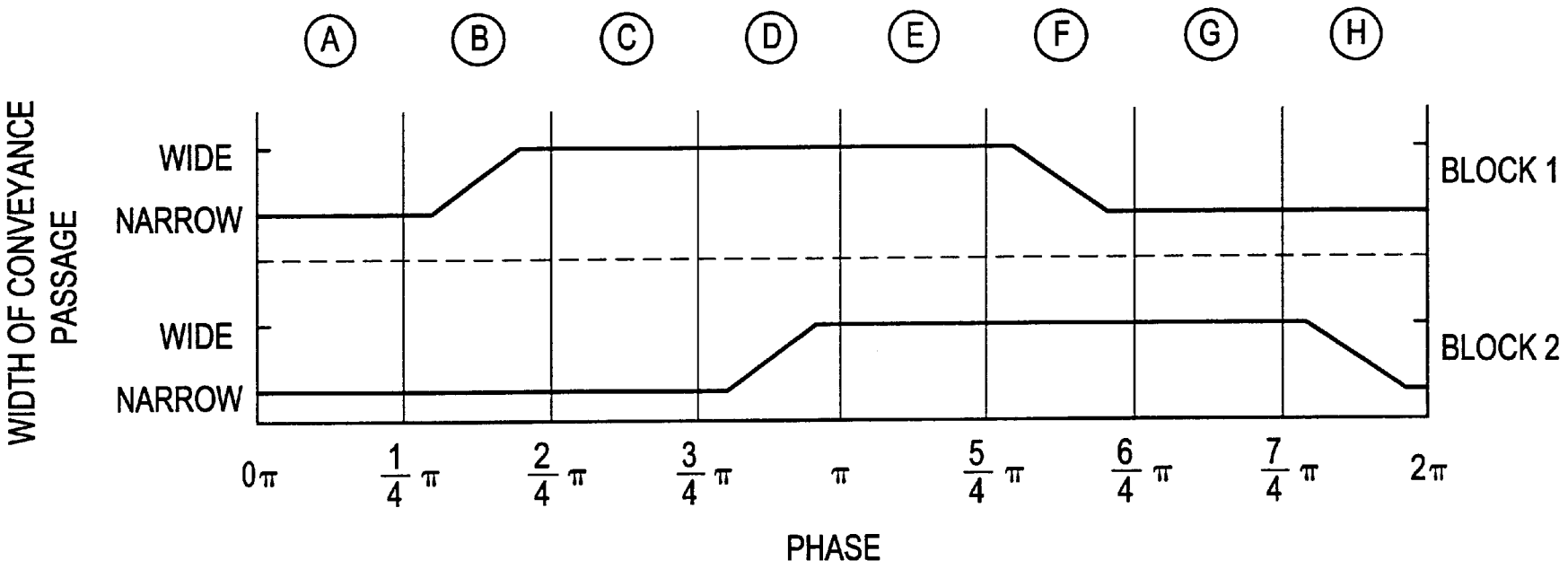
FIG. 4 shows an explanatory diagram illustrating a control method in which processing steps for processing photosensitive materials in the embodiment are divided into two blocks.

When the conveyance passage is divided into two blocks, the cam members 90 corresponding to Block 1 and the cam members 90 corresponding to Block 2 may be arranged respectively so that phase differences shown in FIG. 4 are provided. In this procedure, the processing of control for changing the guide width is performed as follows. When narrow width photosensitive materials are continuously fed, the phase of the cam member 90 corresponding to each of the blocks is changed to a phase shown as a state A in FIG. 4, and the photosensitive materials are introduced so that the interval between the backward end of a preceding photosensitive material and the forward end of a following photosensitive material is not less than the minimum time interval Ts. When wide width photosensitive materials are continuously fed, the phase of each of the cam members 90 is changed to a phase shown as a state E in FIG. 4, and the photosensitive materials are introduced so that the interval between the backward end of a preceding photosensitive material and the forward end of a following photosensitive material is not less than the minimum time interval Ts.

When the widthwise dimension of photosensitive materials changes from the narrow width to the wide width, or when it changes in an opposite manner, the phase of each of the cam members 90 may be changed in an order of states A→B→C, or states E→F→G to start conveyance of a following photosensitive material after the time corresponding to Ts+Tm has passed since the backward end of a preceding photosensitive material passed through the arrangement site of the sensor SE1, and the phase of each of the cam members 90 may be changed in an order of states C→D→E, or states G→H→A after the time corresponding to Ts+Tm has passed since the backward end of the preceding photosensitive material passed through the arrangement site of the sensor SE2.

Figure 5:
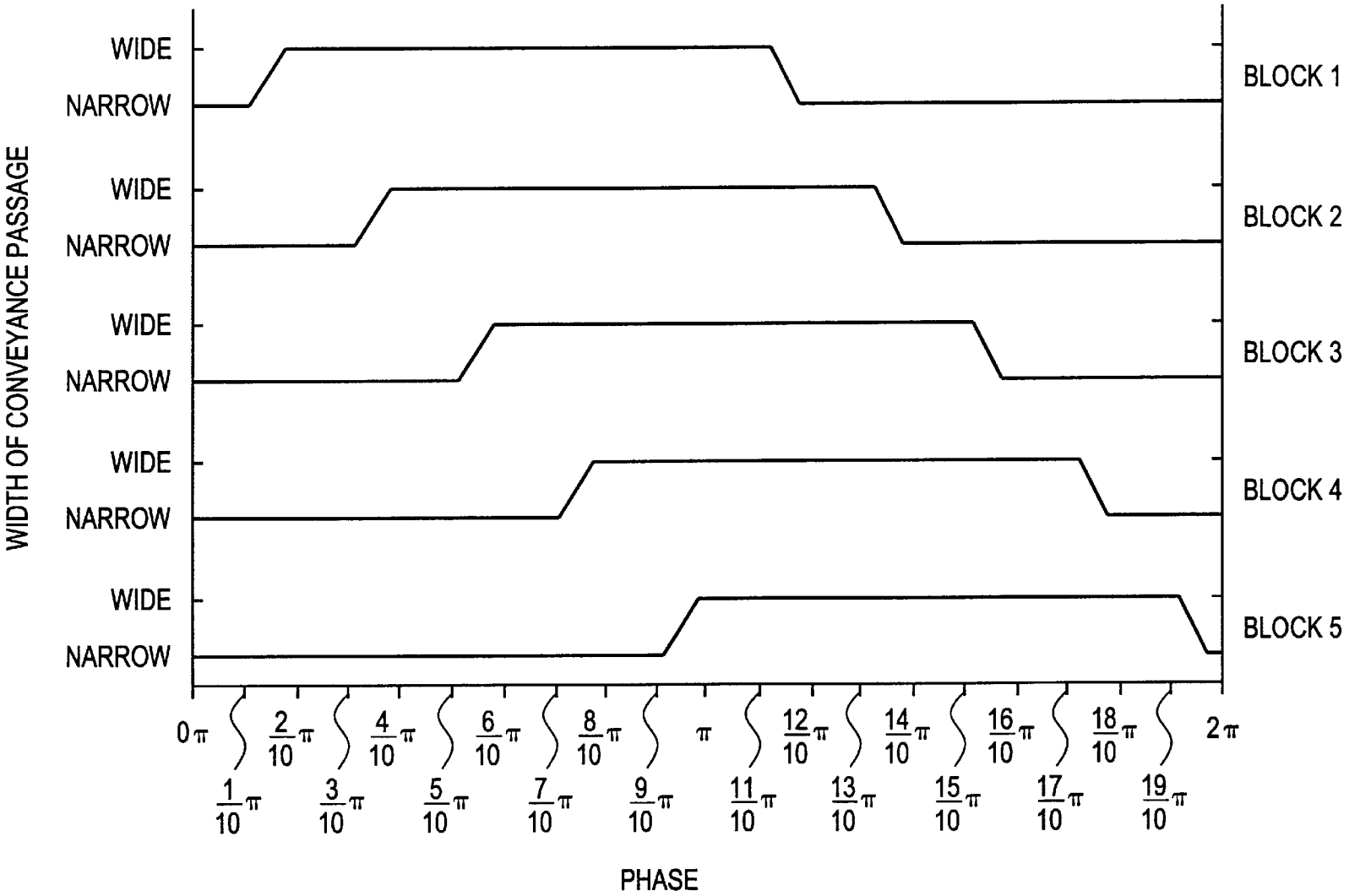
FIG. 5 shows an explanatory diagram illustrating a control method in which processing steps for processing photosensitive materials in the embodiment are divided into five blocks.

When the conveyance passage is divided into five blocks, each of the cam members 90 corresponding to Blocks 1–5 may be arranged respectively so that phase differences shown in FIG. 5 are provided. In the processing of control for changing the guide width, when the widthwise dimension of a preceding photosensitive material and the widthwise dimension of a following photosensitive material are the same, or when they are different, the interval between the backward end of the preceding photosensitive material and the forward end of the following photosensitive material is also the same as that described above. The phase of each of the cam members 90 may be successively switched after the time corresponding to Ts+Tm has passed since the backward end of the preceding photosensitive material passed through each of the sensor arrangement sites.

The present inventors performed the following experiment in order to confirm the degree of improvement in the ability to process photosensitive materials by dividing the photosensitive material conveyance passage into a plurality of blocks, and shortening the processing time in each of the blocks to be as short as possible. The entire length of photosensitive materials was 1,200 mm, and photosensitive materials having different widths were alternately processed. In this experiment, the photosensitive material processing interval, namely the time until feeding of a following photosensitive material having a different widthwise dimension after feeding of a preceding photosensitive material to the apparatus was measured at various conveyance speeds on condition that the number of block was 2, 3, or 5 respectively. Results of the experiment described above are shown in the following Table 1. The number of block of 1 is for comparison, representing a condition in which the conveyance passage was not divided into a plurality of blocks e.g. in the conventional apparatus).

TABLE 2

| | Conveyance speed (mm/sec) | | |
|---|---|---|---|
| Number of block(s) | 10 | 20 | 30 |
| 1 | 560 sec | 500 | 480 |
| 2 | 340 | 280 | 260 |
| 3 | 300 | 240 | 220 |
| 5 | 220 | 160 | 140 sec |

In the conventional apparatus shown as having number of one block, it is impossible to start the processing for a following photosensitive material before the processing for a preceding photosensitive material is completed, and the guide width is changed to a width corresponding to a widthwise dimension of the following photosensitive material. Therefore, the processing interval between the preceding photosensitive material and the following photosensitive material is extremely long. On the contrary, as clarified from Table 1, division into a plurality of blocks makes it possible to shorten the processing interval, and the more the number of divided blocks is, the shorter the processing interval is. Under the condition in which the number of blocks is 5, the average processing time per one photosensitive material for alternately processing photosensitive materials having different widths (including the processing interval described above) can be reduced into a degree of about 40% to 30%, as compared with the conventional apparatus without any division.

In the foregoing, the guide rack, in which the spacing distance between the pair of rack side plates can be enlarged and reduced, is also provided for the drying section 58. However, few troubles occur in the drying section 58 even if the photosensitive material is not well guided meander. Therefore, the guide members for guiding photosensitive materials on their both sides may be omitted in the drying section 58.

In the foregoing, the guide rack 76 for each of the processing tanks has a structure in which one side plate is provided on one side. However, the side plate may be divided into upper and lower parts or the like, and discrete cams can correspond to each of part.

Figure 10:
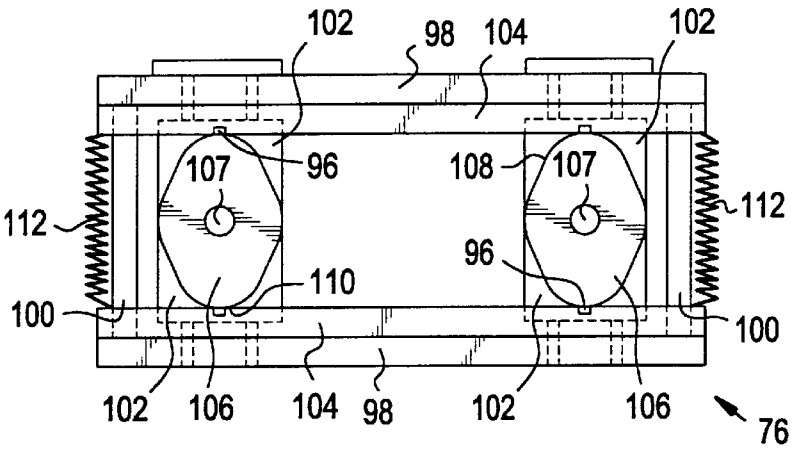
FIG. 10 shows a plan view illustrating a state in which the width of the conveyance passage in the guide rack shown in FIG. 9 of the embodiment is switched to a wide width.
Figure 9:
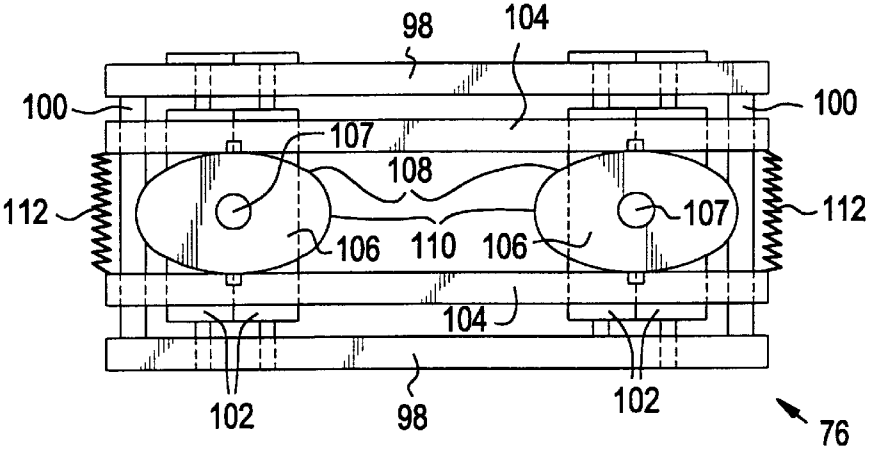
FIG. 9 shows a plan view illustrating a state in which the width of a conveyance passage in a guide rack having another arrangement of the apparatus of the embodiment is switched to a narrow width.

Alternatively, the guide rack 76 may have an arrangement shown in FIGS. 9 and 10. In this guide rack 76, a plurality of guide rods 100 and a plurality of pairs of guide rollers 102 are spanned between a pair of outer side plates 98 at predetermined positions. Further, a pair of rack side plates 104 are arranged between the pair of outer side plates 98. Guide rods 100 are slidably inserted into through holes engraved in each of the rack side plates 104. Guide rollers 102 are rotatably and slidably inserted into shaft holes engraved in each of the rack side plates 104. Each of the rack side plates 104 is movable between the pair of outer side plates 98 while maintaining a parallel state with respect to the outer side plates 98.

Two cam members 106 are arranged between the pair of rack side plates 104. The pair of rack side plates 104 are allowed to abut against the two cam members 106 so that the former forcedly interposes the latter by using the urging force of tensile coil springs 112 spanned under tension at both ends of the pair of rack side plates 104. The cam members are approximately ellipsoidal. Their circular arc portions 108 having a small diameter abut against the rack side plates 104 respectively to set a conveyance passage for narrow width photosensitive materials 78 as shown in FIG. 9.

The cam members 106 are constructed such that they are rotated by rotating their main shafts 107 by the driving force of a motor (not shown). Rotation of the cam members 106 allows their circular arc portions 110 having a large diameter to abut against the rack side plates 104 respectively to set a conveyance passage for wide width photosensitive materials 78 as shown in FIG. 10. The main shafts 107 are coupled to the cam members 106 of the guide racks 76 arranged in each of the processing tanks, and these cams are rotated simultaneously but with phase differences.

Guide grooves 96 are engraved in opposing side surfaces of each of the rack side plate 104 along a conveyance route for photosensitive materials 78 set by the guide rollers 102 respectively. The center of the spacing distance between the rack side plates 104, 104 is used as a reference position, and the photosensitive material 78 is conveyed so that its center in the widthwise direction approximately coincides with the reference position described above. Both sides of the photosensitive material 78 enter each of the guide grooves 96 to make guidance for the conveying operation for the photosensitive material 78.

In the foregoing, the embodiment has been explained, in which the conveyance passage in the development processing section of the processing apparatus for photograph printing is divided into a plurality of blocks, and the guide width in each of the blocks set by the rack side plates 80, 82 is changed by using the single driving source (motor 191). However, it is needless to say that the guide width in each of the blocks may be changed by using a plurality of driving sources provided corresponding to each of the blocks.

Second Embodiment

Next, the second embodiment of the present invention will be explained. The second embodiment is similar to the first embodiment. The same reference numerals are used to label similar parts. Only, parts different from those of the first embodiment will be explained for the processing of control for changing the guide width according to the second embodiment with reference to flow charts in FIG. 13.

In the flow charts in FIG. 12 explained in the first embodiment, when the preceding photosensitive material has the narrow width, and the following photosensitive material in waiting has the wide width, then it is judged in the step 314 whether or not the time corresponding to Ts+Tm has passed since the backward end of the preceding narrow width photosensitive material in processing passed through the arrangement site of the sensor SE1, and the routine waits until the judgment is affirmed. However, in the flow charts in FIG. 13 according to the second embodiment, if the judgment in the step 314 is negated, it is judged in a step 315 whether or not a time corresponding to a sum of the predetermined time Tm and a predetermined time T0 has passed since the forward end of the preceding photosensitive material passed through the arrangement site of the sensor SE1. If the judgment in the step 315 is negated, the routine returns to the step 314, and waits until the judgment in the step 314 or the step 315 is affirmed.

If the preceding narrow width photosensitive material has a short entire length, the judgment in the step 314 is affirmed before the judgment in the step 315 is affirmed (this situation is the same as that in the first embodiment). However, if the preceding narrow width photosensitive material has a sufficiently long entire length, the judgment in the step 315 is affirmed prior to the step 314, the routine proceeds to the step 316, and the guide width in Block 1 is changed from the narrow width to the wide width. In this situation, there is a possibility that a backward end portion of the preceding narrow width photosensitive material remains in Block 1. The backward end portion remaining in Block 1 is in a state in which the guidance for the both sides by the rack side plates 80, 82 is canceled. However, a forward end portion of the preceding narrow width photosensitive material having penetrated into Block 2 is guided on its both sides by the rack side plates 80, 82 in Block 2 with the guide width which is the narrow width. Moreover, the length of the forward end portion of the preceding narrow width photosensitive material having penetrated into Block 2 is not less than a length corresponding to the predetermined time T0 described above. Thus the backward end portion remaining in Block 1 is discharged from Block 1 without any occurrence of conveyance failure or the like.

Figure 13A:
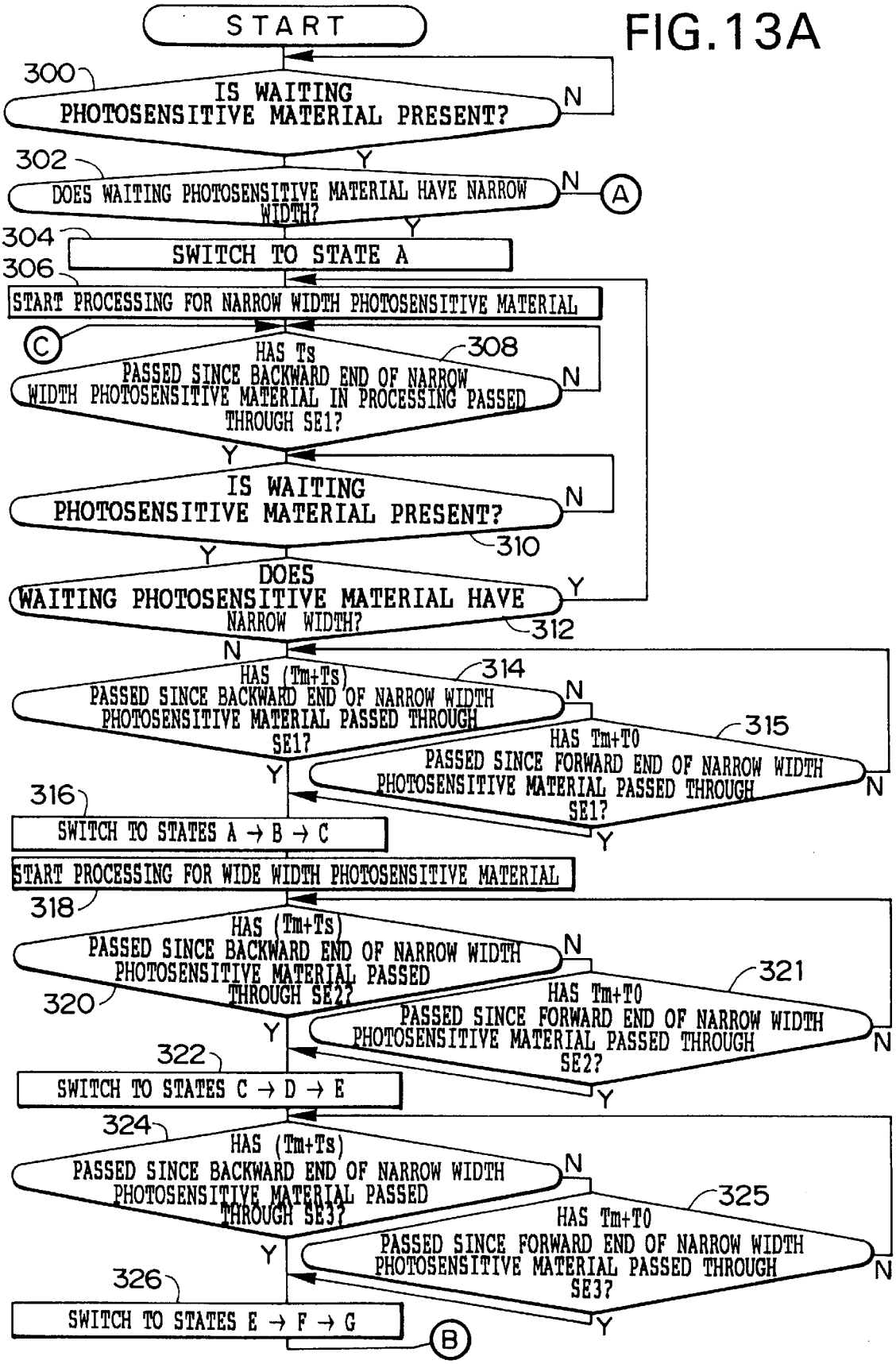
FIG. 13A shows a flow chart illustrating processing steps of control for changing the guide width in the second embodiment.

In the flow charts in FIG. 13, if the judgment in the step 320 is negated, the routine proceeds to a step 321. It is judged whether or not the time corresponding to Tm+T0 has passed since the forward end of the preceding narrow width photosensitive material passed through the arrangement site of the sensor SE2 in the same manner as described above. If the judgment is negated, the routine returns to the step 320, and waits until the judgment in the step 320 or the step 321 is affirmed. In the same manner, if the judgment in the step 324 is negated, the routine proceeds to a step 325. It is judged whether or not the time corresponding to Tm+T0 has passed since the forward end of the preceding narrow width photosensitive material passed through the arrangement site of the sensor SE3 in the same manner as described above. If the judgment is negated, the routine returns to the step 324, and waits until the judgment in the step 324 or the step 325 is affirmed.

In the foregoing, the preceding narrow width photosensitive material is detected in any case, and the guide width in Block 2 or Block 3 is changed to the guide width corresponding to the following wide width photosensitive material after the length of the forward end portion discharged from Block 2 or Block 3 and guided on its both sides with the guide width corresponding to the narrow width becomes not less than the length corresponding to the predetermined time T0. Thus no conveyance failure or the like does not occur at the backward end portion of the preceding narrow width photosensitive material.

In the second embodiment as described above, when the preceding photosensitive material has the narrow width, the following photosensitive material has the wide width, and the entire length of the preceding photosensitive material is long, then the interval between the backward end of the preceding narrow width photosensitive material and the forward end of the following wide width photosensitive material is further shortened. Thus the ability to process photosensitive materials can be further improved.

Third Embodiment

Figure 14:
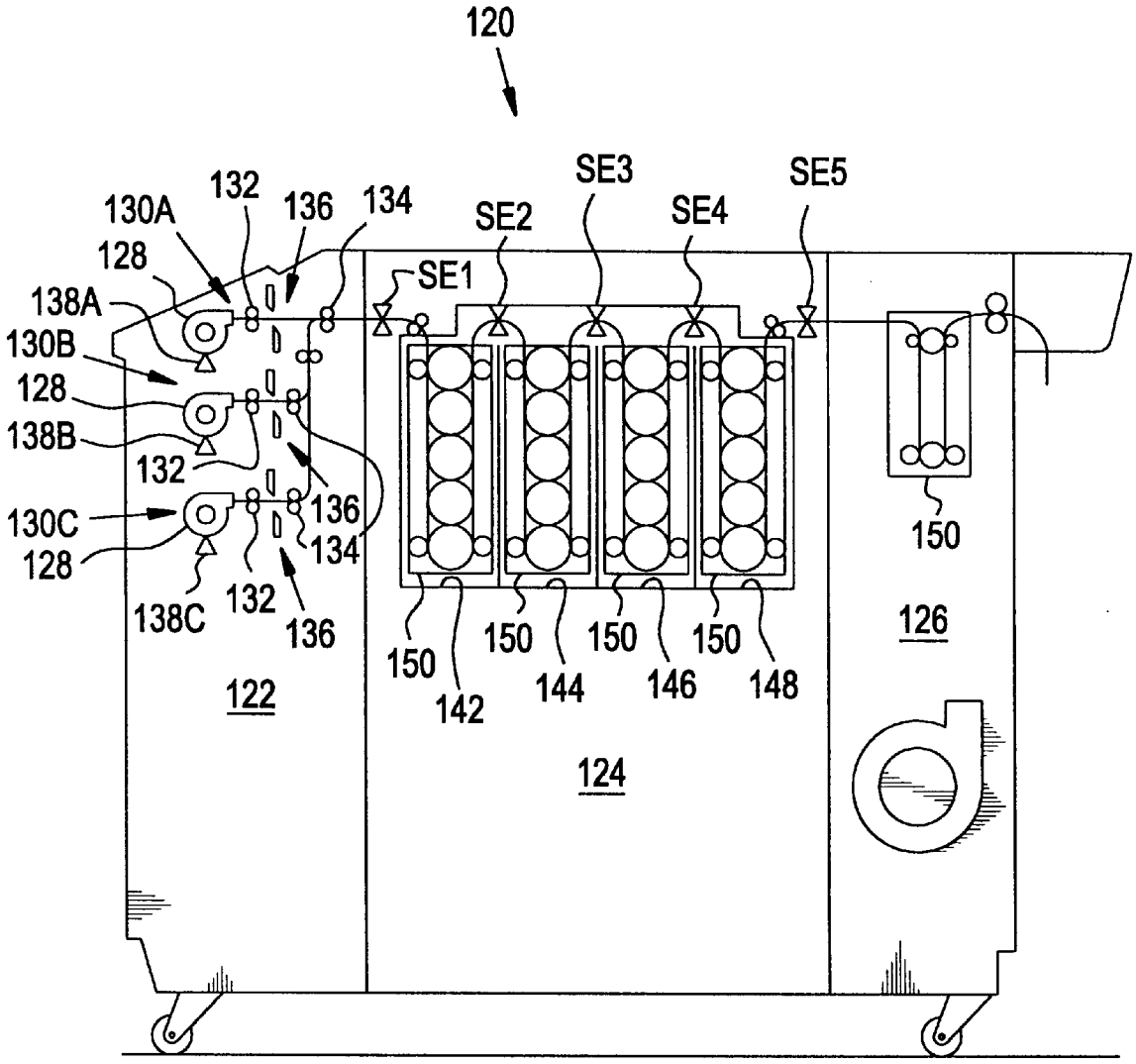
FIG. 14 shows a schematic arrangement of an apparatus for processing photosensitive materials according to the third embodiment.

Next, the third embodiment of the present invention will be explained. The same parts as those in the first embodiment are designated by the same reference numerals, explanation of which is omitted. FIG. 14 shows an apparatus for processing photosensitive materials (film processor) 120 according to the third embodiment. The apparatus for processing photosensitive materials 120 comprises a photosensitive material charging section 122, a processor section 124, and a drying section 126. The photosensitive material charging section 122 is provided with a plurality of setting units 130 to which cartridges 128 containing a photosensitive material (film) is set. FIG. 14 shows three setting units 130A to 130C by way of example.

Each of the setting units 130 is arranged with a pair of rollers 132, 134 for interposing and conveying a photosensitive material drawn from the cartridge 128, and a cutter 136 for cutting a backward end portion of the photosensitive material drawn from the cartridge 128 and separating it from the cartridge 128. A mark for representing a widthwise dimension or the like of the photosensitive material accommodated in each of the cartridges 128 is given to the cartridge 128. The setting units 130A to 130C are provided with reading sensors 138A to 138C having a function to read the mark respectively (for example, bar code readers when the mark comprises bar codes). The reading sensors 138A to 138C make it possible to detect the presence or absence of the cartridge 128 set in the setting units 130A to 130C, and the widthwise dimension of the photosensitive material accommodated in the cartridge 128.

Figure 15:
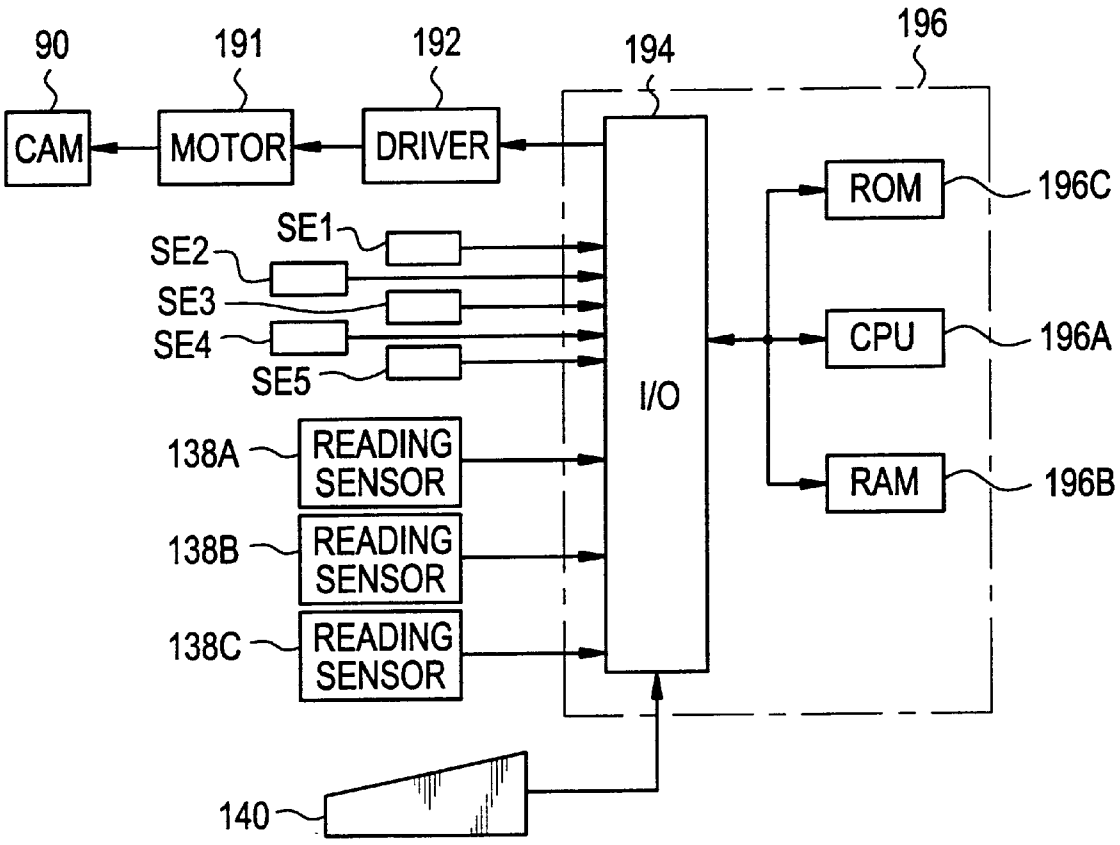
FIG. 15 shows a block diagram illustrating a control unit according to the third embodiment.

As shown in FIG. 15, the reading sensors 138A to 138C are connected to a control unit 196 respectively. A keyboard 140 for inputting various data, commands and so on is also connected to the control unit 196. The keyboard 140 corresponds to the designating means in the sixth aspect described above.

The processor section 124 is arranged with a color development tank 142, a bleaching tank 144, a fixation tank 146, and a stabilization tank 148 in this order. A color developing solution, a bleaching solution, a fixing solution, and a stabilization solution are stored in each of the tanks respectively. Guide racks 150 for conveying photosensitive materials are provided in each of the tanks and the drying section 126. Although the guide racks 150 have different numbers and arrangement of rollers, their guide widths are changeable in the same manner as the guide racks 76 explained in the first embodiment. The guide width is changed by the cain members 90 which are rotated by transmission of the driving force of a motor 191. The photosensitive material fed to the processor section 124 is fed into each of the tanks through the guide racks 76 provided in each of the tanks, and it is immersed and processed in the processing solutions stored in each of the tanks. After that, it is fed to the drying section 126, and discharged after moisture or the like adhered to its surface is dried.

Sensors SE1 to SE5 for detecting passage of the photosensitive material are provided on photosensitive material incoming sides of the color development tank 142, the bleaching tank 144, the fixation tank 146, the stabilization tank 148, and the drying section 126 respectively. The sensors SE1 to SE5 are connected to the control unit 196 respectively.

Figure 16:
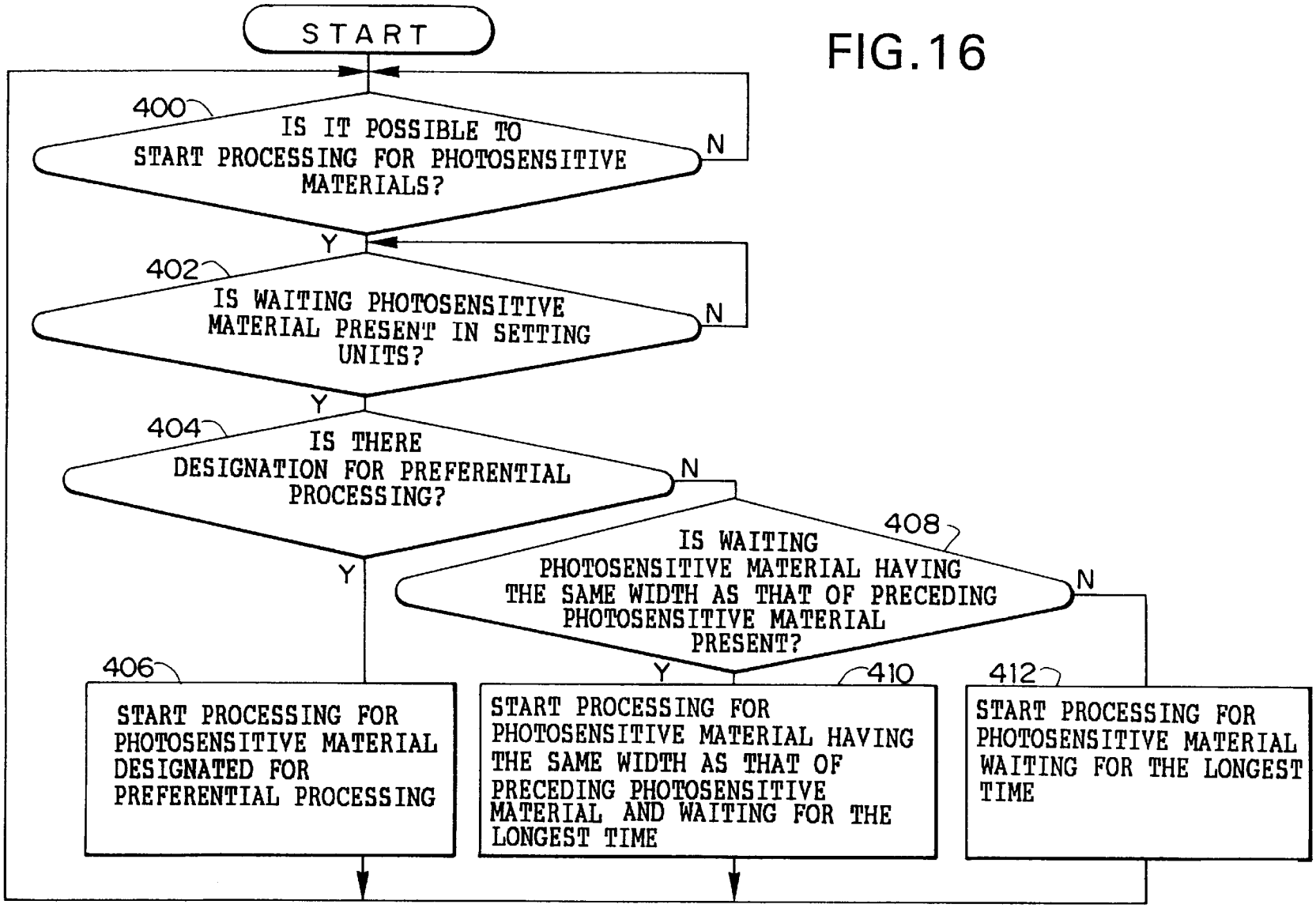
FIG. 16 shows a flow chart illustrating processing steps for selecting processing films in the third embodiment.

Next, the operation of the third embodiment will be explained. The control unit 196 executes the same processing as the processing of control for changing the guide width explained in the first or second embodiment on the basis of detection results of the sensors SE1 to SE5. The number of Blocks after division may be any one of 2–5. On the other hand, in the third embodiment, processing steps for selecting processing films shown in FIG. 16 are performed prior to introduction of photosensitive materials into the processor section 124.

Namely, it is judged in a step 400 whether or not a state is given in which it is possible to start processing for photosensitive materials in the processor section 124. If the judgment is negated, the routine waits until a state is given in which it is possible to start processing. If the judgment in the step 400 is affirmed, it is judged in a step 402 whether or not any waiting photosensitive material is present in the setting units 130A to 130C, namely whether or not any cartridge containing an unprocessed photosensitive material is set, on the basis of signals outputted from the reading sensors 138A to 138C. The routine waits until the judgment is affirmed.

If the judgment in the step 402 is affirmed, it is judged in a step 404 whether or not a photosensitive material to be preferentially processed by the apparatus for processing photosensitive materials 120 is designated among photosensitive materials set in at least any one of the setting units 130A to 130C. If a photosensitive material to be preferentially processed is designated through the keyboard 140, the judgment is affirmed, and preparative processing is performed in a step 406 to start processing for the designated photosensitive material to be preferentially processed.

Namely, a rotary shaft to which an end of the photosensitive material is fastened is rotated in a predetermined amount for the cartridge 128 which accommodates the designated photosensitive material to be preferentially processed. A forward end of the photosensitive material is drawn from the cartridge 128, and interposed by the pair of rollers 132. Next, the pairs of rollers 132, 134 are driven to successively draw the photosensitive material from the cartridge 128. When the forward end of the photosensitive material is interposed by the pair of rollers 134 provided corresponding to the setting unit 130A (the pair of rollers 134 arranged in the vicinity of the photosensitive material incoming side of the processor section 124), and the forward end of the photosensitive material is detected by the sensor SE1, then the drawing of the photosensitive material is stopped.

Conveyance of the photosensitive material is started again upon arrival of a predetermined timing to start processing, and the photosensitive material is successively fed to the processor section 124. In the flow charts in FIG. 12, the timing to start processing is given when the judgments in the steps 308–312 are affirmed, or the judgments in the steps 332–336 are affirmed, if the widthwise dimension of the drawn photosensitive material described above is equal to that of a preceding photosensitive material. If the widthwise dimension of the drawn photosensitive material described above is different from that of a preceding photosensitive material, the timing is given when the judgment in the step 314 or the step 344 is affirmed. When all of the photosensitive material is drawn from the cartridge 128, the photosensitive material is cut at its backward end and separated from the cartridge by operating the cutter 136 concurrently with conveyance of the photosensitive material.

According to the procedure described above, even when a situation arises in which a specified photosensitive material should be preferentially processed, if the specified photosensitive material is designated as a photosensitive material to be preferentially processed through the keyboard, the specified photosensitive material is preferentially processed.

On the other hand, if the judgment in the step 404 is negated, it is judged in a step 408 whether or not any photosensitive material is present which has the same widthwise dimension as that of a photosensitive material proximately processed in the processor section 124 (hereinafter referred to as "preceding photosensitive material") among photosensitive materials in waiting. If the judgment in the step 408 is affirmed, preparative processing is performed in a step 410 in the same manner as described above for a photosensitive material which has the same widthwise dimension as that of the preceding photosensitive material, and has the longest passed time after charged to the photosensitive material charging section 122, namely which is waiting for the longest time.

In this situation, the spacing distance of each of the racks arranged in each of the processing tanks in the processor section 124 is set to be a spacing distance corresponding to the widthwise dimension of the preceding photosensitive material. The timing to start processing arrives when at least the minimum time interval Ts has passed since the backward end of the preceding photosensitive material passed through the arrangement site of the sensor SE1. Thus according to the procedure described above, the processing ability of the apparatus for processing photosensitive materials 120 is improved. The steps 404, 406, 408, 410 correspond to the processing order control means defined in the seventh aspect described above.

If no photosensitive material having the same widthwise dimension as that of the preceding photosensitive material is present among waiting photosensitive materials, the judgment in the step 408 is negated, and preparative processing is performed in a step 412 in the same manner as described above for a photosensitive material waiting for the longest time.

In the foregoing, the minimum interval between a selected photosensitive material and the preceding photosensitive material is determined by comparing the widthwise dimension of the preceding photosensitive material with the widthwise dimension of the photosensitive material to be subsequently selected and processed. Thus it is possible to calculate and display a required period of time until completion of processing for the photosensitive material. By doing so, an operator for the apparatus for processing photosensitive materials can accurately estimate a photosensitive material to be preferentially processed, considering the degree of emergency of the photosensitive material to be processed at a certain point of time, and the displayed period of time required for processing.

Fourth Embodiment

Next, the fourth embodiment of the present invention will be explained. The fourth embodiment is similar to the third embodiment. Thus explanation the basic arrangement is omitted. In the fourth embodiment, a setting unit to which a cartridge 128 containing a photosensitive material to be preferentially processed is set (hereinafter referred to as "setting unit for preferential processing") is previously determined among a plurality of setting units 130A to 130C provided in the photosensitive material charging section 122.

Figure 17:
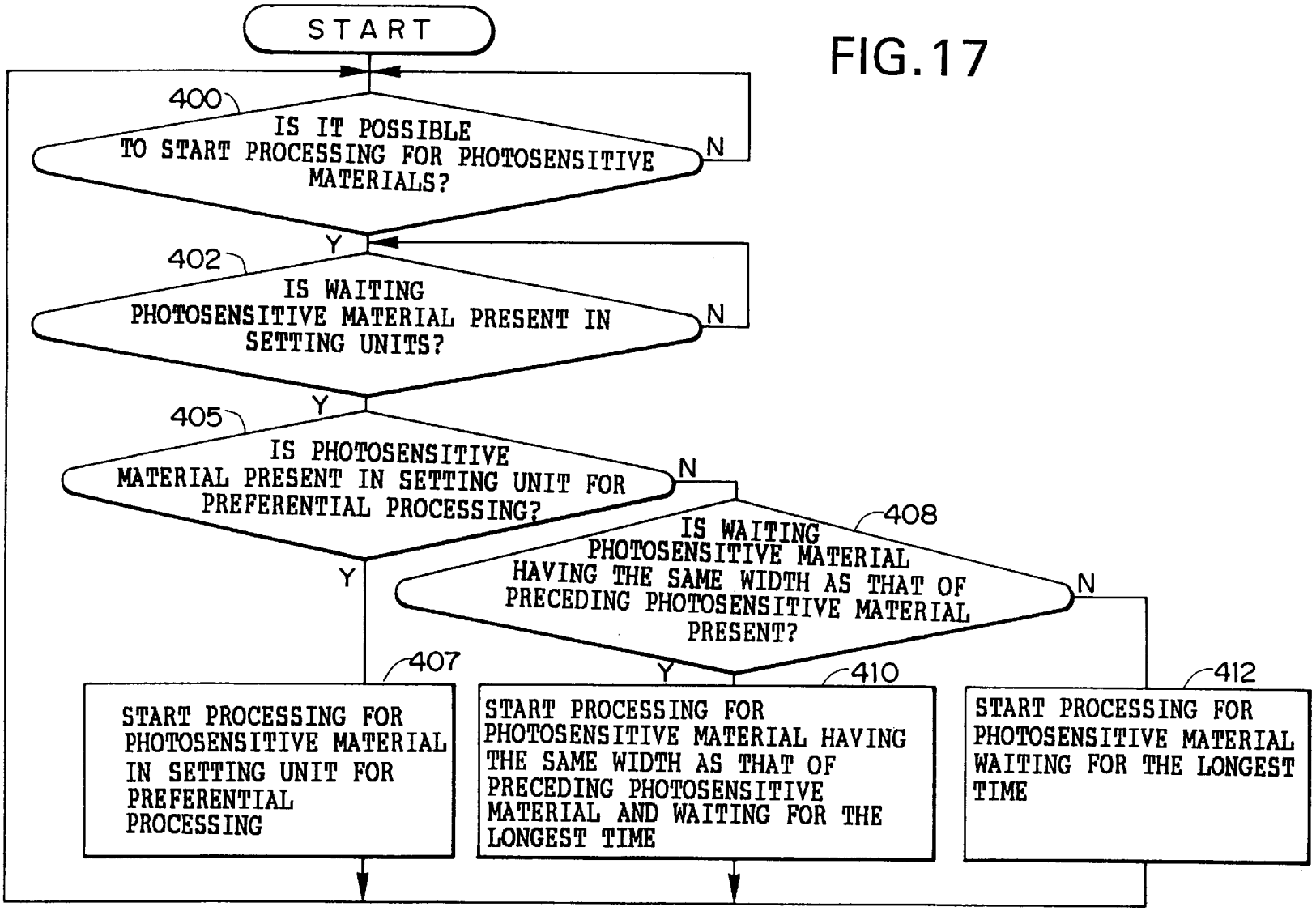
FIG. 17 shows a flow chart illustrating processing steps for selecting processing films in the fourth embodiment.
Figure 18:
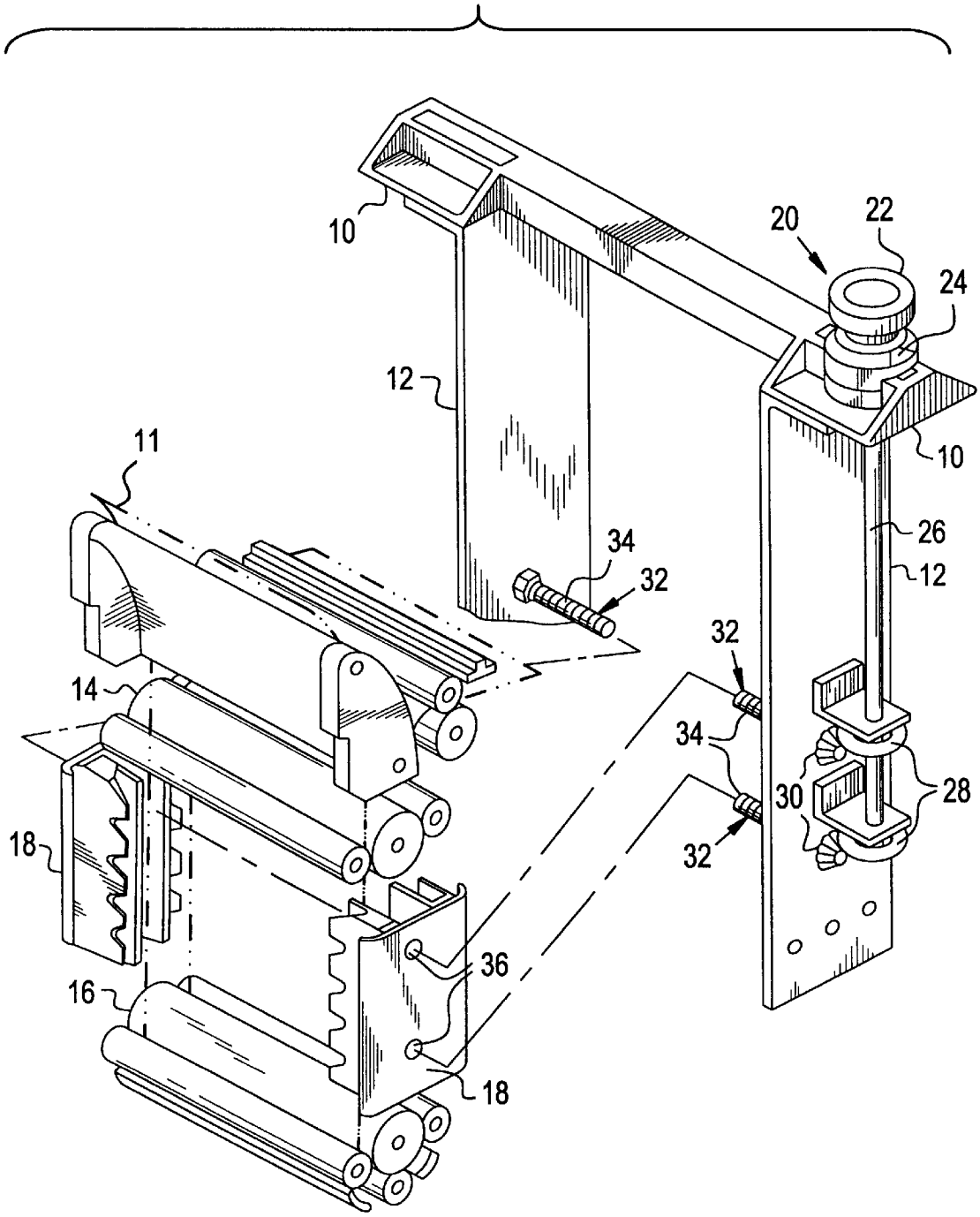
FIG. 18 PRIOR ART
FIG. 18 shows an exploded perspective view illustrating a conventional guide rack in which the width of a conveyance passage is changeable.

As shown in FIG. 17, in the fourth embodiment, if it is judged that the apparatus for processing photosensitive materials 120 is in a state capable of processing, and the cartridge 128 is set in at least any one of the setting unit 130A to the setting unit 130C (if the judgments in the steps 400, 402 are affirmed), then it is judged in a step 405 whether or not any photosensitive material is present in the setting unit for preferential processing, namely whether or not the cartridge 128 is set in the setting unit for preferential processing. If the judgment in the step 405 is affirmed, the preparative processing described above is performed in a step 407 for a photosensitive material accommodated in the cartridge 128 set in the setting unit for preferential processing 130.

The steps 405, 407 correspond to the processing order control means in the eighth aspect described above. It is unnecessary to previously designate a photosensitive material to be preferentially processed through the keyboard 140. When the cartridge 128 is set in the setting unit for preferential processing, it is automatically judged that the photosensitive material accommodated in the cartridge 128 is the photosensitive material to be preferentially processed, and the processing is performed. Thus the load of an operator can be relieved.

The present invention can be broadly applied to apparatus for various photosensitive materials such as negative film, x-ray film, and photographic paper. It is needless to say that the present invention can be applied even if the printing section 54, the development processing section 56, and the processor section 124 of the apparatus for processing photosensitive materials explained in the embodiments described above have structures other than the structures illustrated in the embodiments described above.

What is claimed is:

1. A method for processing photosensitive materials in which photosensitive materials are conveyed along a serial conveyance passage while guiding the photosensitive materials on both sides thereof by using pairs of guide members to successively perform development processing steps, comprising:

dividing the conveyance passage into a plurality of blocks wherein a spacing distance between the pair of guide members on the conveyance passage is changeable in each of the divided blocks; and changing the spacing distance between the pair of guide members in at least one of the blocks, when a photosensitive material having a different widthwise dimension is introduced into the conveyance passage, in accordance with the widthwise dimension of the photosensitive material, before introducing a forward end of the photosensitive material having the different widthwise dimension into said at least one of the blocks with fixed phase differences between the spacing distance state of the guide members in successive blocks.

2. The method for processing photosensitive materials according to claim 1, wherein the changing step is successively performed for each of the blocks by using an identical driving source from upstream to downstream blocks in a direction of conveyance in accordance with movement of the photosensitive materials.

3. The method for processing photosensitive materials according to claim 1, wherein the changing step is performed by moving at least one of the pair of guide members.

4. The method for processing photosensitive materials according to claim 3, wherein the movement of the guide members is performed by using cam means.

5. The method for processing photosensitive materials according to claim 1, wherein the division of the conveyance passage into a plurality of blocks is performed so that the time period for processing the photosensitive materials in each of the blocks are substantially equal to one another.

6. An apparatus for processing photosensitive materials, comprising:

a plurality of pairs of guide members with changeable spacing distances between each of them for successively guiding photosensitive materials on both sides thereof conveyed from upstream to downstream sides on a serial conveyance passage for performing development processing steps on the photosensitive materials, wherein the plurality of the pairs of the guide members are divided into groups from upstream and downstream sides so that they are included in each of a plurality of blocks; and a spacing distance changing means for changing the spacing distances between the guide members of each of the pairs with fixed phase differences between the spacing distance state of the guide members in successive blocks.

7. The apparatus for processing photosensitive materials according to claim 6, wherein the spacing distance changing means includes a plurality of cam means provided to correspond to each of the pairs of guide members respectively for changing the spacing distances between the guide members of each of the pairs, the cam means have different phases for each of the guide members in each of the blocks, and they are driven by a single driving source.

8. The apparatus for processing photosensitive materials according to claim 6, further comprising a conveyance control means for comparing a widthwise dimension of a preceding photosensitive material precedently introduced into the conveyance passage and processed with a widthwise dimension of a following photosensitive material subsequently introduced into the conveyance passage and processed, and changing a minimum interval between a backward end of the preceding photosensitive material and a forward end of the following photosensitive material conveyed on the conveyance passage in accordance with a result of the comparison.

9. The apparatus for processing photosensitive materials according to claim 7, further comprising a conveyance control means for comparing a widthwise dimension of a preceding photosensitive material precedently introduced into the conveyance passage and processed with a widthwise dimension of a following photosensitive material subsequently introduced into the conveyance passage and processed, and changing a minimum interval between a backward end of the preceding photosensitive material and a forward end of the following photosensitive material conveyed on the conveyance passage in accordance with a result of the comparison.

10. The apparatus for processing photosensitive materials according to claim 6, further comprising:

a plurality of setting units capable of setting photosensitive materials to be introduced into the conveyance passage and processed respectively; and a designating means for designating a setting unit for preferential processing in which a photosensitive material to be preferentially introduced into the conveyance passage and processed is set, among the plurality of setting units.

11. The apparatus for processing photosensitive materials according to claim 7, further comprising:

a plurality of setting units capable of setting photosensitive materials to be introduced into the conveyance passage and processed respectively; and a designating means for designating a setting unit for preferential processing in which a photosensitive material to be preferentially introduced into the conveyance passage and processed is set, among the plurality of setting units.

12. The apparatus for processing photosensitive materials according to claim 8, further comprising:

a plurality of setting units capable of setting photosensitive materials to be introduced into the conveyance passage and processed respectively; and a designating means for designating a setting unit for preferential processing in which a photosensitive material to be preferentially introduced into the conveyance passage and processed is set, among the plurality of setting units.

13. The apparatus for processing photosensitive materials according to claim 9, further comprising:

a plurality of setting units capable of setting photosensitive materials to be introduced into the conveyance passage and processed respectively; and a designating means for designating a setting unit for preferential processing in which a photosensitive material to be preferentially introduced into the conveyance passage and processed is set, among the plurality of setting units.

14. The apparatus for processing photosensitive materials according to claim 10, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

15. The apparatus for processing photosensitive materials according to claim 11, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

16. The apparatus for processing photosensitive materials according to claim 12, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

17. The apparatus for processing photosensitive materials according to claim 13, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

18. The apparatus for processing photosensitive materials according to claim 6, further comprising:

a plurality of setting units capable of setting photosensitive materials to be introduced into the conveyance passage and processed respectively; and a processing order control means for preferentially introducing a set photosensitive material into the conveyance passage to perform processing when the photosensitive material is set in a predetermined and specified setting unit.

19. The apparatus for processing photosensitive materials according to claim 7, further comprising:

a plurality of setting units capable of setting photosensitive materials to be introduced into the conveyance passage and processed respectively; and a processing order control means for preferentially introducing a set photosensitive material into the conveyance passage to perform processing when the photosensitive material is set in a predetermined and specified setting unit.

20. The apparatus for processing photosensitive materials according to claim 8, further comprising:

a plurality of setting units capable of setting photosensitive materials to be introduced into the conveyance passage and processed respectively; and a processing order control means for preferentially introducing a set photosensitive material into the conveyance passage to perform processing when the photosensitive material is set in a predetermined and specified setting unit.

21. The apparatus for processing photosensitive materials according to claim 9, further comprising:

a plurality of setting units capable of setting photosensitive materials to be introduced into the conveyance passage and processed respectively; and a processing order control means for preferentially introducing a set photosensitive material into the conveyance passage to perform processing when the photosensitive material is set in a predetermined and specified setting unit.

22. A method for processing photosensitive materials in which photosensitive materials are conveyed along a serial conveyance passage while guiding the photosensitive materials on both sides thereof by using pairs of guide members to successively perform development processing steps, comprising:

dividing the conveyance passage into a plurality of blocks wherein a spacing distance between the pair of guide members on the conveyance passage is changeable in each of the divided blocks; and changing the spacing distance between the pair of guide members in at least one of the blocks by moving at least one of the guide members with a cam means when a photosensitive material having a different widthwise dimension is introduced into the conveyance passage, in accordance with the widthwise dimension of the photosensitive material, before introducing a forward end of the photosensitive material having the different widthwise dimension into said at least one of the blocks.

23. An apparatus for processing photosensitive materials, comprising:

a plurality of pairs of guide members with changeable spacing distances between each of them for successively guiding photosensitive materials on both sides thereof conveyed from upstream to downstream sides on a serial conveyance passage for performing development processing steps on the photosensitive materials, wherein the plurality of the pairs of the guide members are divided into groups from upstream and downstream sides so that they are included in each of a plurality of blocks; and a spacing distance changing means for changing the spacing distances between the guide members of each of the pairs with provision of phase differences from upstream to downstream blocks, said spacing distance changing means comprising a plurality of cam means provided to correspond to each of the pairs of guide members respectively for changing the spacing distances between the guide members of each of the pairs of guide members, the cam means having different phases for each of the guide members in each of the blocks and the cam means being driven by a single drive source.

24. The apparatus for processing photosensitive materials according to claim 23, further comprising a conveyance control means for comparing a widthwise dimension of a preceding photosensitive material precedently introduced into the conveyance passage and processed with a widthwise dimension of a following photosensitive material subsequently introduced into the conveyance passage and processed, and changing a minimum interval between a backward end of the preceding photosensitive material and a forward end of the following photosensitive material conveyed on the conveyance passage in accordance with a result of the comparison.

25. The apparatus for processing photosensitive materials according to claim 23, further comprising:

a plurality of setting units capable of setting photosensitive materials to be introduced into the conveyance passage and processed respectively; and a designating means for designating a setting unit for preferential processing in which a photosensitive material to be preferentially introduced into the conveyance passage and processed is set, among the plurality of setting units.

26. The apparatus for processing photosensitive materials according to claim 24, further comprising:

a plurality of setting units capable of setting photosensitive materials to be introduced into the conveyance passage and processed respectively; and a designating means for designating a setting unit for preferential processing in which a photosensitive material to be preferentially introduced into the conveyance passage and processed is set, among the plurality of setting units.

27. The apparatus for processing photosensitive materials according to claim 25, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

28. The apparatus for processing photosensitive materials according to claim 26, further comprising a processing order control means for preferentially introducing a photosensitive material set in a designated setting unit for preferential processing into the conveyance passage to perform processing when the setting unit for preferential processing is designated by the designating means, or preferentially introducing a photosensitive material capable of being processed under the same condition as that for a preceding photosensitive material proximately introduced into the conveyance passage into the conveyance passage to perform processing among photosensitive materials set in each of the setting units when no setting unit for preferential processing is designated.

29. The apparatus for processing photosensitive materials according to claim 23, further comprising:

a plurality of setting units capable of setting photosensitive materials to be introduced into the conveyance passage and processed respectively; and a processing order control means for preferentially introducing a photosensitive material into the conveyance passage to perform processing when the photosensitive material is set in a predetermined and specified setting unit.

30. The apparatus for processing photosensitive materials according to claim 24, further comprising:

a plurality of setting units capable of setting photosensitive materials to be introduced into the conveyance passage and processed respectively; and a processing order control means for preferentially introducing a set photosensitive material into the conveyance passage to perform processing when the photosensitive material is set in a predetermined and specified setting unit.

31. A method for processing photosensitive materials in which photosensitive materials are conveyed along a serial conveyance passage while guiding the photosensitive materials on both sides thereof by using pairs of guide members to successively perform development processing steps, comprising:

dividing the conveyance distance into a plurality of blocks wherein a spacing distance between the pair of guide members on the conveyance passage is changeable in each of the divided blocks; and changing the spacing distance between the pair of guide members in at least one of the blocks when a photosensitive material having a different widthwise dimension is introduced into the conveyance passage, in accordance with the widthwise dimension of the photosensitive material before introducing a forward end of the photosensitive material having the different widthwise dimension into said at least one of the blocks, wherein the division of the conveyance passage into a plurality of blocks is performed so that the time period for the photosensitive materials in each of the divided blocks are substantially equal to one another.

32. An apparatus for processing photosensitive materials, comprising:

a plurality of pairs of guide members with changeable spacing distances between each of them for successively guiding photosensitive materials on both sides thereof conveyed from upstream to downstream sides on a serial conveyance passage for performing development processing steps on the photosensitive materials, wherein the plurality of the pairs of the guide members are divided into groups from upstream and downstream sides so that they are included in each of a plurality of blocks; and a spacing distance changing means for changing the spacing distances between the guide members of each of the pairs with provision of phase differences from upstream to downstream blocks, said spacing distance changing means comprising a plurality of cam means provided to correspond to each of the pairs of guide members respectively for changing the spacing distances between each of the pairs of guide members, the cam means having different phases for each of the guide members in each of the blocks;

each of said blocks being divided into m intervals and each of said cams has a phase of $n\ \pi/m$ where m is a positive integer and n=1, 2, 3, . . . 2m.

33. A method for processing photosensitive materials in which photosensitive materials are conveyed along a serial conveyance passage while guiding the photosensitive materials on both sides thereof by using pairs of guide members to successively perform development processing steps, comprising:

dividing the conveyance passage into a plurality of blocks wherein a spacing distance between the pair of guide members on the conveyance passage is changeable in each of the divided blocks; and changing the spacing distance between at least one of the pair of guide members when a photosensitive material having a different widthwise dimension than a preceding photosensitive material is introduced into the conveyance passage while the preceding photosensitive material is still in the conveyance passage, in accordance with the widthwise dimension of the photosensitive material, before introducing a forward end of the photosensitive material having the different widthwise dimension into said at least one of the blocks.

* * * * *